US009500978B2

(12) United States Patent
Nakayama et al.

(10) Patent No.: US 9,500,978 B2
(45) Date of Patent: Nov. 22, 2016

(54) IMAGE FORMING APPARATUS INCLUDING ELECTRIC CHARGE REMOVING DEVICE AND METHOD OF FORMING IMAGE

(71) Applicants: Masayoshi Nakayama, Kanagawa (JP); Takuma Higa, Kanagawa (JP); Hiroyuki Kunil, Kanagawa (JP); Masaki Sukesako, Kanagawa (JP); Kazuaki Kamihara, Tokyo (JP); Masakazu Terao, Ishikawa (JP); Yuichi Aizawa, Kanagawa (JP); Masahiro Katoh, Kanagawa (JP); Kohei Matsumoto, Tokyo (JP); Toshihiro Sugiyama, Tokyo (JP)

(72) Inventors: Masayoshi Nakayama, Kanagawa (JP); Takuma Higa, Kanagawa (JP); Hiroyuki Kunil, Kanagawa (JP); Masaki Sukesako, Kanagawa (JP); Kazuaki Kamihara, Tokyo (JP); Masakazu Terao, Ishikawa (JP); Yuichi Aizawa, Kanagawa (JP); Masahiro Katoh, Kanagawa (JP); Kohei Matsumoto, Tokyo (JP); Toshihiro Sugiyama, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/794,025

(22) Filed: Jul. 8, 2015

(65) Prior Publication Data

US 2016/0026109 A1 Jan. 28, 2016

(30) Foreign Application Priority Data

Jul. 25, 2014 (JP) ..... 2014-151973
Sep. 22, 2014 (JP) ..... 2014-192639

(51) Int. Cl.
*G03G 21/00* (2006.01)
*G03G 15/02* (2006.01)
*G03G 21/06* (2006.01)
*G03G 21/08* (2006.01)

(52) U.S. Cl.
CPC ..... *G03G 15/0275* (2013.01); *G03G 21/06* (2013.01); *G03G 21/08* (2013.01)

(58) Field of Classification Search
CPC ..... G03G 15/0233; G03G 15/0275
See application file for complete search history.

(56) References Cited

U.S. PATENT DOCUMENTS 3,533,784 A * 10/1970 Graff ..... G03G 15/22 250/315.3

(Continued)

FOREIGN PATENT DOCUMENTS

JP 60-257480 12/1985
JP 61-043777 3/1986

(Continued)

*Primary Examiner* — David Bolduc
(74) *Attorney, Agent, or Firm* — Cooper & Dunham LLP

(57) ABSTRACT

An image forming apparatus includes a first electric charging unit having an electric discharge wire to uniformly electrify a surface of the electrostatic latent image bearer, a second electric charging unit having a second electric discharge wire to execute a pre-electric charge removal electric charging process by electrifying the surface of the electrostatic latent image bearer subsequent to a transfer process to transfer a toner image, and a first electric charge removing device to diselectrify the surface of the electrostatic latent image bearer by irradiating it with electric charge removing light subsequent to the pre-electric charge removal electric charging process. The first electric charge removing device is disposed within an electric discharge region of the second electric discharge wire on a downstream side of an extreme upstream edge of the electric discharge region of the second electric discharge wire in a rotational direction of the electrostatic latent image bearer.

18 Claims, 21 Drawing Sheets

(56) References Cited

U.S. PATENT DOCUMENTS 3,778,623 A * 12/1973 Sato ..... G03G 13/02 250/325
3,886,416 A * 5/1975 Gallo, Jr. ..... G03G 15/0291 361/229
3,932,877 A * 1/1976 Ohnishi ..... G03G 21/08 15/1.51
4,034,221 A * 7/1977 Yamashita ..... G03G 15/0275 250/324
4,141,648 A * 2/1979 Gaitten ..... G03G 15/0291 250/325
4,201,465 A * 5/1980 Oyama ..... G03G 21/0005 15/1.51
4,408,865 A * 10/1983 Camis ..... G03G 15/24 250/324
4,413,897 A * 11/1983 Kohyama ..... G03G 21/08 250/324
4,585,330 A * 4/1986 Yamamoto ..... G03G 15/047 355/71
4,728,982 A * 3/1988 Takemura ..... G03G 15/047 355/67
4,785,324 A * 11/1988 Yamazaki ..... G03G 21/08 399/128
4,884,107 A * 11/1989 Watanabe ..... G03G 15/605 347/112
4,970,562 A * 11/1990 Birnbaum ..... G03G 15/01 347/119
5,030,992 A * 7/1991 Yoneda ..... G03G 15/047 399/186
5,065,188 A * 11/1991 Kobayashi ..... G03G 15/047 362/800
5,392,098 A * 2/1995 Ehara ..... G03G 5/08228 399/159
5,530,524 A * 6/1996 Tsujita ..... G03G 5/0681 399/162
5,559,580 A * 9/1996 Niizawa ..... G03G 21/08 399/168
5,933,177 A * 8/1999 Pollutro ..... G03G 21/06 347/123
6,330,413 B1 * 12/2001 Yamamoto ..... G03G 15/047 399/186
7,254,349 B2 * 8/2007 Kamiya ..... G03G 15/0291 399/171
2004/0136756 A1 * 7/2004 Kabashima ..... G03G 15/04 399/296
2007/0098445 A1 * 5/2007 Takiguchi ..... G03G 15/0266 399/171
2007/0147864 A1 * 6/2007 Markovics ..... G03G 21/08 399/50
2010/0221043 A1 * 9/2010 Gotoda ..... G03G 15/0291 399/171
2010/0221044 A1 * 9/2010 Klenkler ..... G03G 15/0208 399/171
2011/0142481 A1 * 6/2011 Kwak ..... G03G 15/0291 399/92
2011/0305471 A1 * 12/2011 Ichikawa ..... G03G 15/0291 399/50
2012/0230732 A1 * 9/2012 Otsuka ..... G03G 15/0291 399/171
2013/0101309 A1 * 4/2013 Inami ..... G03G 15/0291 399/92
2013/0165036 A1 * 6/2013 Kudo ..... G03G 15/0291 454/284
2013/0243486 A1 * 9/2013 Satoh ..... G03G 15/0208 399/174
2013/0305942 A1 * 11/2013 Gila ..... B41F 16/0006 101/401.1
2014/0079431 A1 * 3/2014 Orikasa ..... G03G 15/0258 399/92
2014/0119767 A1 * 5/2014 Inami ..... G03G 15/0291 399/92
2014/0140718 A1 * 5/2014 Kudo ..... G03G 15/0291 399/92
2014/0169825 A1 * 6/2014 Momomura ..... F24F 13/0245 399/92

FOREIGN PATENT DOCUMENTS

JP 3-035553 U 4/1991
JP 1-133825 5/1999
JP 2006017974 A * 1/2006
JP 2006017976 A * 1/2006
JP 2006350020 A * 12/2006
JP 2008-122783 5/2008

* cited by examiner

IMAGE FORMING APPARATUS INCLUDING ELECTRIC CHARGE REMOVING DEVICE AND METHOD OF FORMING IMAGE

CROSS-REFERENCE TO RELATED APPLICATIONS

This patent application is based on and claims priority pursuant to 35 U.S.C. §119(a) to Japanese Patent Application Nos. 2014-151973, filed on Jul. 25, 2014, and 2014-192639, filed on Sep. 22, 2014, in the Japan Patent Office, the entire disclosures of which are hereby incorporated by reference herein.

BACKGROUND

Technical Field

Embodiments of this invention relate to an image forming apparatus, such as a copier, a facsimile machine, a printer, etc., that includes an electric charge removing device that diselectrifies an electrostatic latent image bearer after a transfer process is applied thereto by a transfer device.

Related Art

In a common image forming apparatus that employs an electrophotographic system, an image is formed by executing the below-described processes.

That is, an electrostatic latent image bearer such as a rotary photoconductor, etc., is initially electrified uniformly by an electric charging unit. An optical writing process (e.g. an exposure process) is then applied to the electrostatic latent image bearer by an optical writing device such as optical scanning device, etc., to form an electrostatic latent image on the electrostatic latent image bearer. The electrostatic latent image is then rendered visible by a developing device as a toner image. The toner image obtained in this way is subsequently transferred onto either a recording sheet or an intermediate transfer member or the like by a transfer device, such as a transfer roller, etc., from the electrostatic latent image bearer. Some toner generally remains on the surface of the electrostatic latent image bearer after completion of the transfer process, but is removed therefrom by a cleaning unit after that. In addition, after the transfer process is completed, some electric charge also generally remains on the electrostatic latent image bearer. However, since such residual electric charge sometimes generates an afterimage, the residual electric charge is accordingly removed by an electric charge removing device such as an electric charge removing lamp, etc.

In an attempt to prevent afterimage formation, comparative image forming apparatuses employ a second electric charging unit such as a corotron charger (i.e., an electric charging device using corona discharge) separate from a first electric charging unit that uniformly electrifies a surface of an electrostatic latent image bearer to apply a prescribed bias voltage to the surface of an electrostatic latent image bearer while having a polarity opposite to that of a bias voltage applied thereto by a transfer device before the electric charge removing device removes the residual electric charge thereon. That is, the comparative image forming apparatus attempts to prevent occurrence of the afterimage.

SUMMARY

Accordingly, one aspect of the present invention provides a novel image forming apparatus that includes a rotary electrostatic latent image bearer to bear an electrostatic latent image, a first electric charging unit having at least one first electric discharge wire to uniformly electrify a surface of the electrostatic latent image bearer, and an electrostatic latent image writing device to write an electrostatic latent image on the surface of the electrostatic latent image bearer electrified by the first electric charging unit. The image forming apparatus further includes a developing device to render the electrostatic latent image borne on the electrostatic latent image bearer visible as a toner image with toner, a transfer device to transfer the toner image obtained by developing the electrostatic latent image onto a transfer medium in a transfer process, and a second electric charging unit having a second electric discharge wire to execute a pre-electric charge removal electric charging process by electrifying the surface of the electrostatic latent image bearer after completion of the transfer process executed by the transfer device. Further included in the image forming apparatus is a first electric charge removing device to diselectrify the surface of the electrostatic latent image bearer by irradiating the surface of the electrostatic latent image bearer with electric charge removing light subsequent to the pre-electric charge removal electric charging process. The at least one first electric discharge wire provided in the first electric charging unit and the second electric discharge wire provided in the second electric charging unit are integrally accommodated in a single housing. The second electric discharge wire provided in the second electric charging unit is disposed upstream of the at least one first electric discharge wire in a rotational direction of the electrostatic latent image bearer. The first electric charge removing device is disposed within an electric discharge region of the second electric discharge wire. The first electric charge removing device irradiates the surface of the electrostatic latent image bearer with the electric charge removing light on a downstream side of an extreme upstream edge of the electric discharge region of the second electric discharge wire in the rotational direction of the electrostatic latent image bearer.

Another aspect of the present invention provides a novel image forming method of forming an image including the steps of: driving a rotary electrostatic latent image bearer; uniformly electrifying a surface of the electrostatic latent image bearer with a first electric charging unit having at least one first electric discharge wire; and optically writing an electrostatic latent image on the surface of the electrostatic latent image bearer electrified by the first electric charging unit. The method further includes the steps of: rendering the electrostatic latent image borne on the electrostatic latent image bearer visible as a toner image with toner with a developing device; transferring the toner image obtained by developing the electrostatic latent image onto a transfer medium with a transfer device in a transfer process; and electrifying the surface of the electrostatic latent image bearer with a second electric charging unit having a second electric discharge wire in a pre-electric charge removal electric charging process after the step of transferring the toner image in the transfer process with the transfer device. The at least one first electric discharge wire and the second electric discharge wire are accommodated in a single housing. The second electric discharge wire is disposed upstream of the at least one first electric discharge wire in a rotational direction of the electrostatic latent image bearer. The method further includes the step of diselectrifying the surface of the electrostatic latent image bearer by irradiating electric charge removing light thereto with a first electric charge removing device after the step of electrifying the surface of the electrostatic latent image bearer in the pre-electric charge removal electric charging process. The first electric charge removing device is disposed within an electric discharge region of the second electric discharge wire. The first electric charge removing device irradiates the surface of the electrostatic latent image bearer with the electric charge removing light on a downstream side of an extreme upstream edge of the electric discharge region of the second electric discharge wire in the rotational direction of the electrostatic latent image bearer.

BRIEF DESCRIPTION OF THE DRAWINGS

A more complete appreciation of the present invention and many of the attendant advantages thereof will be more readily obtained as substantially the same becomes better understood by reference to the following detailed description when considered in connection with the accompanying drawings, wherein.

DETAILED DESCRIPTION

Figure 14:
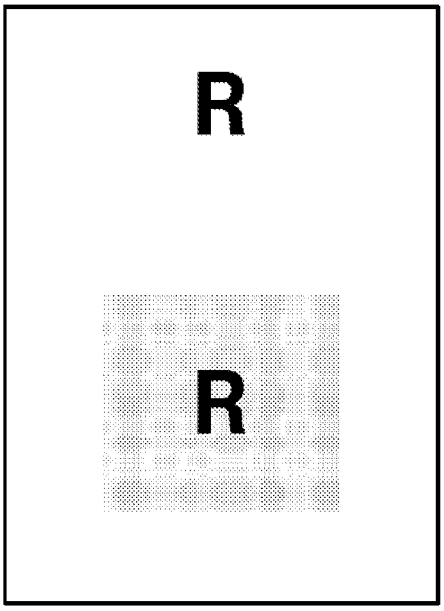
FIG. 14 is a diagram specifically illustrating a typical afterimage as a comparative example.

In general, the afterimage generated in an image forming apparatus includes a so-called positive afterimage and/or a so-called positive ghost. That is, as illustrated in FIG. 14, when a contrast image is formed in a prescribed surface portion of an electrostatic latent image bearer and an intermediate density image such as a halftone image, etc., is subsequently formed in the same surface portion of an electrostatic latent image bearer, the previously formed contrast image undesirably appears again in the intermediate density image. Polarity inversion is another factor that causes the afterimage in the comparative image forming apparatus. That is, this type of afterimage is caused when a polarity of a surface potential of an electrostatic latent image bearer is reversed after a transfer process. The polarity inversion phenomenon, in which the polarity of a surface potential of an electrostatic latent image bearer is reversed after a transfer process, is briefly described herein below.

When an entire surface of the rotary photoconductor is negatively charged to bear a prescribed voltage having a negative polarity and is then exposed, the polarity of an exposed surface portion of the rotary photoconductor changes to a positive side. After a visible toner image is formed on the surface of the rotary photoconductor in a developing process, since a bias voltage having a positive polarity is applied to a transfer device to transfer toner of the visible toner image, the voltage of the surface of the rotary photoconductor entirely shifts to the positive polarity side again. For this reason, when the transfer process is completed, the potential of the exposed surface portion of the rotary photoconductor is sometimes reversed to be the positive polarity while exceeding zero volts (0 volts). In such a surface portion of the electrostatic latent image bearer (i.e., the rotary photoconductor), in which the potential is reversed to the positive polarity from the negative polarity, an electric charge having a positive polarity tends to remain even when an electric charge removing device irradiates the surface portion of the electrostatic latent image bearer with electric charge removing light. With this, the afterimage ultimately occurs as a result.

Figure 15:
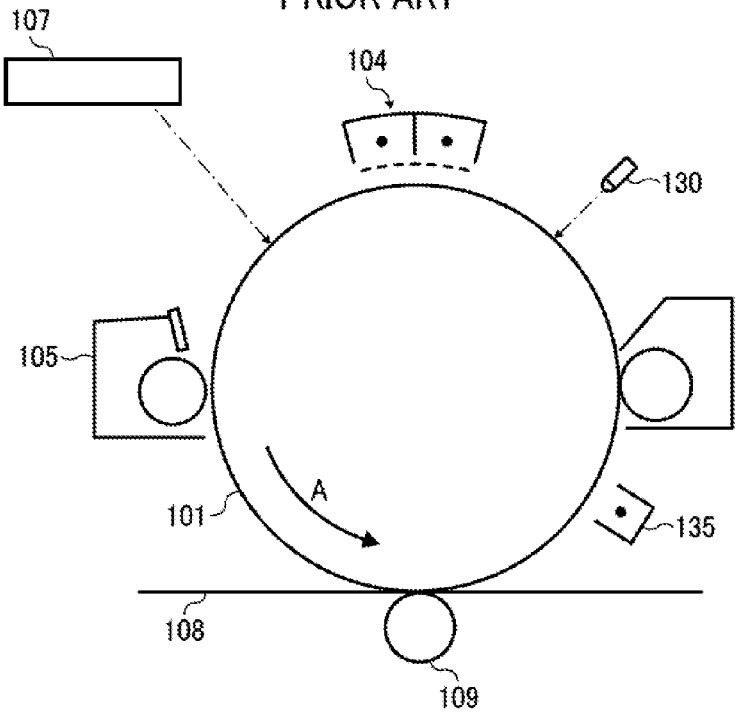
FIG. 15 PRIOR ART
FIG. 15 is a diagram schematically illustrating a configuration of a toner image forming unit provided in a conventional printer.
Figure 16:
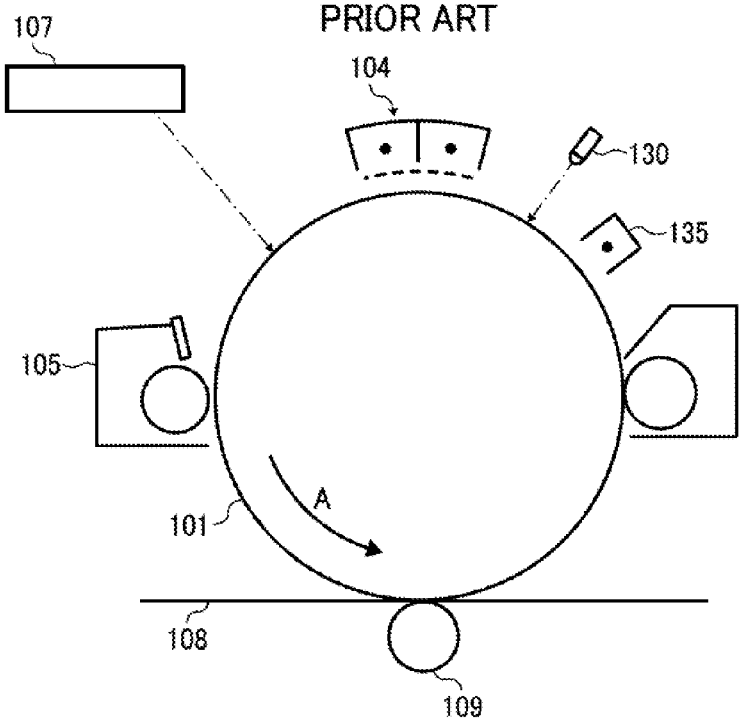
FIG. 16 PRIOR ART
FIG. 16 is a diagram schematically illustrating another configuration of the toner image forming unit provided in another conventional printer.
Figure 17:
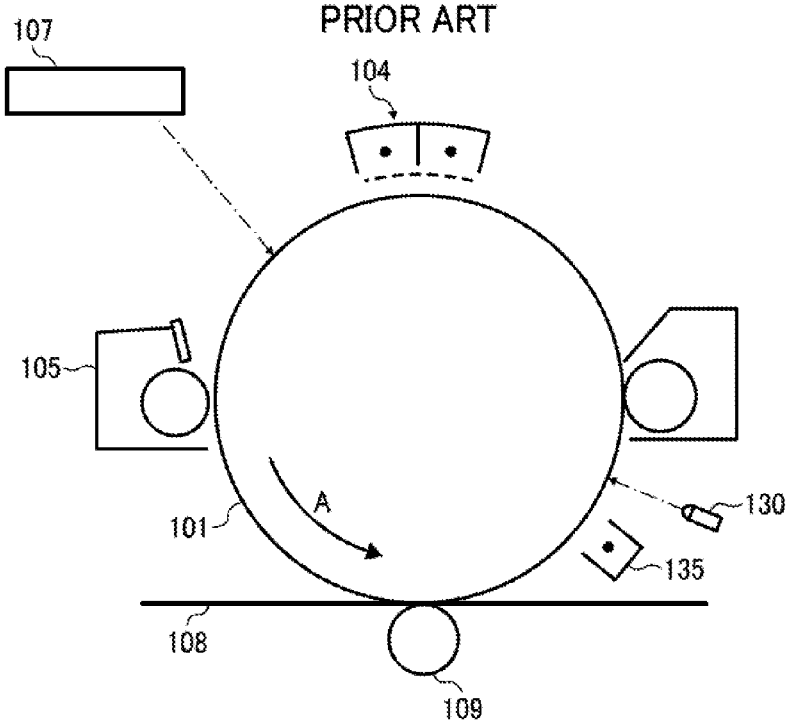
FIG. 17 PRIOR ART
FIG. 17 is a diagram schematically illustrating yet another configuration of the toner image forming unit provided in yet another conventional printer.

To suppress the afterimage of the above-described phenomenon, the surface portion of the electrostatic latent image bearer with the polarity reversed to the positive side as a result of the transfer process needs to be once returned to the negative polarity prior to an electric charge removing process. Because of this, a bias voltage with a positive polarity is applied to the entire surface of an electrostatic latent image bearer, which is accordingly opposite a negative polarity of a bias voltage applied by the transfer device (hereinafter simply referred to as a pre-electric charge removal electric charging process). Since the electrostatic latent image bearer needs to be electrified to prepare for the next image formation at the same time when the above-described pre-electric charge removal electric charging process is executed, another electric charging unit (i.e., a second electric charging unit) is generally separately disposed in a comparative image forming apparatus from the electric charging unit (i.e., a first electric charging unit) to execute the pre-electric charge removal electric charging process. For example, in the comparative image forming apparatus, a first electric charging unit 104 to uniformly charge a rotary photoconductor 101, an exposing device 107 acting as an optical writing device, a developing device 105 acting as a developing unit, a first transfer bias roller 109 acting as a transfer device, a cleaning unit 102 acting as a cleaning device, and an intermediate transfer belt 108 acting as a transfer member or the like are disposed around the rotary photoconductor 101. In the comparative image forming apparatus, an electric charge removing device 130 and a second electric charging device 135 are disposed at prescribed respective positions as shown in FIGS. 15 to 17. That is, in any one of situations of FIGS. 15 to 17, the electric charge removing device 130 is disposed between the first transfer bias roller 109 and the first electric charging unit 104 to execute an electric charge removing process between the electric charging process for the next image formation and the transfer process of the current image formation. Since the electric charging process needs to be executed by the second electric charging device 135 before the electric charge removing process is executed by the electric charge removing device 130, the second electric charging device 135 is disposed upstream of the electric charge removing device 130 in a rotational direction of the rotary photoconductor 101 as shown by arrow A in the drawings of FIGS. 15 to 17.

In general, since the electric charging unit that charges the electrostatic latent image bearer with electricity using an electric discharge wire generally generates ozone during operation thereof, an ozone purifying mechanism is needed to purify air containing ozone (hereinafter simply referred to as an ozone treatment system). The ozone treatment system generally includes an ozone filter to take in and pass air existing around the electric charging unit while containing ozone through the ozone filter thereby reducing a density of the ozone to a prescribed acceptable level.

In addition, since corona products also generally occur when the electric discharge wire included in the electric charging unit operates, poor electric discharge likely occurs when the corona products adhere to the electric discharge wire. To prevent such poor electric discharge, a cleaning mechanism is required to clean the electric discharge wire (hereinafter simply referred to as an electric charging unit cleaning mechanism) on a regular basis.

When two electric charging units are employed as in the comparative example system, each of the electric charging units needs the electric charging unit cleaning mechanism and the ozone treatment system as well, thereby upsizing the system. At the same time, because a mechanism of the system becomes complex, the system increases the cost. Accordingly, various embodiments of the present invention are herein below described in view of the above-described problem, and one object of the present invention is to provide an image forming apparatus capable of preventing occurrence of an afterimage without separately employing an additional electric charging unit separately from the electric charging unit that uniformly charges an electrostatic latent image bearer. Referring now to the drawings, wherein like reference numerals designate identical or corresponding parts throughout the several views thereof, and in particular to FIG. 1, one embodiment of the present invention typically applied to a color printer hereinafter simply referred to as a printer 100 that employs an electrophotographic system as an image forming apparatus is described. First of all, a basic configuration of the printer 100 is described with reference to FIG. 1 which schematically illustrates the configuration thereof according to one embodiment of the present invention. That is, as shown there, the printer 100 includes four toner image forming units 6Y, 6M, 6C, and 6K to form toner images of yellow, magenta, cyan, and black colors (hereinafter simply referred to as Y, M, C, and K), respectively. Although these four toner image forming units 6Y, 6M, 6C, and 6K respectively use Y, M, C, and K color toner particles as image-forming substances having different colors from each other, configurations and operation of these toner image forming units 6Y, 6M, 6C, and 6K are otherwise substantially the same with each other.

Figure 1:
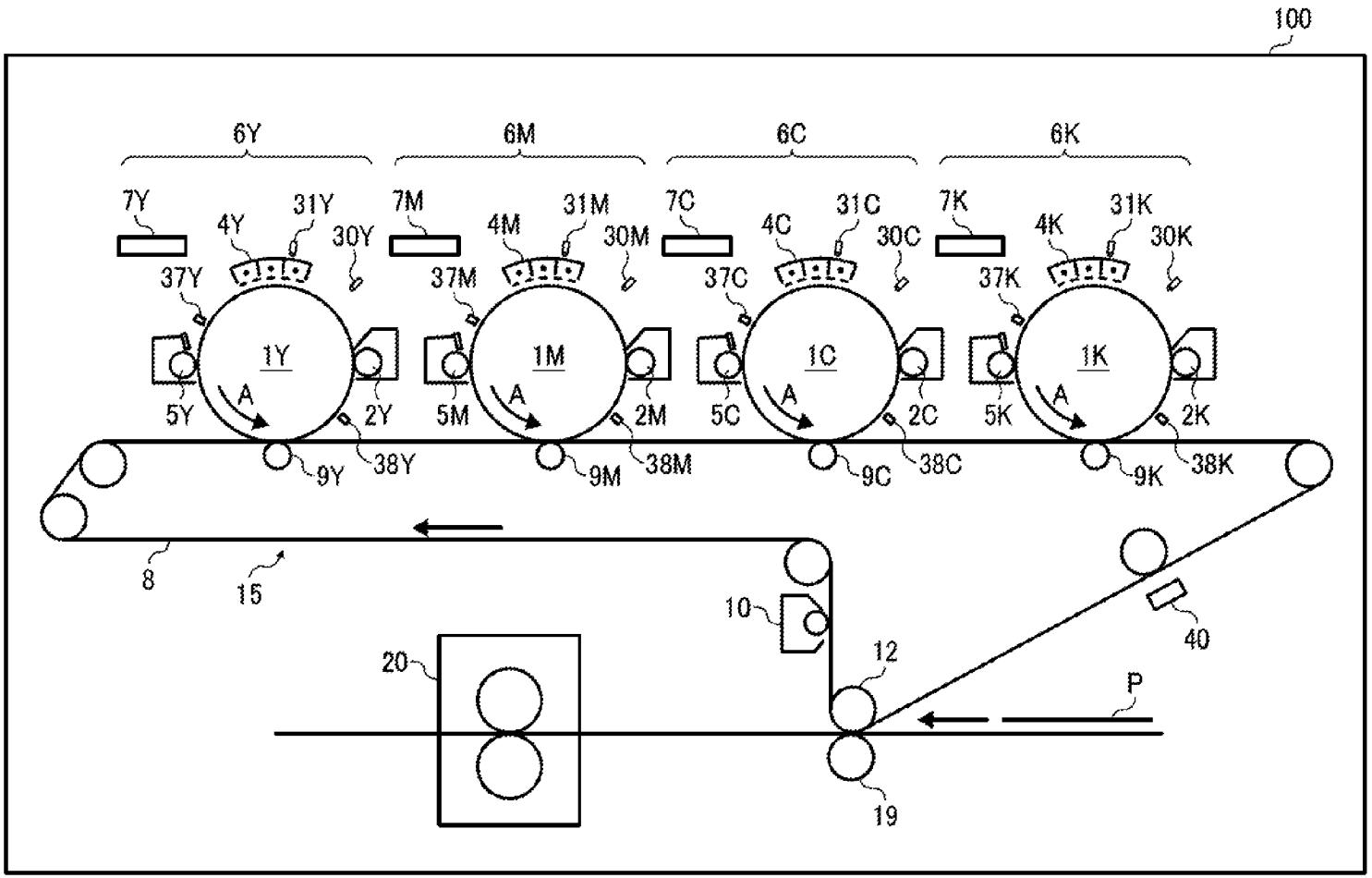
FIG. 1 is a diagram schematically illustrating an exemplary configuration of a printer according to one embodiment (i.e., a first embodiment) of the present invention.
Figure 2:
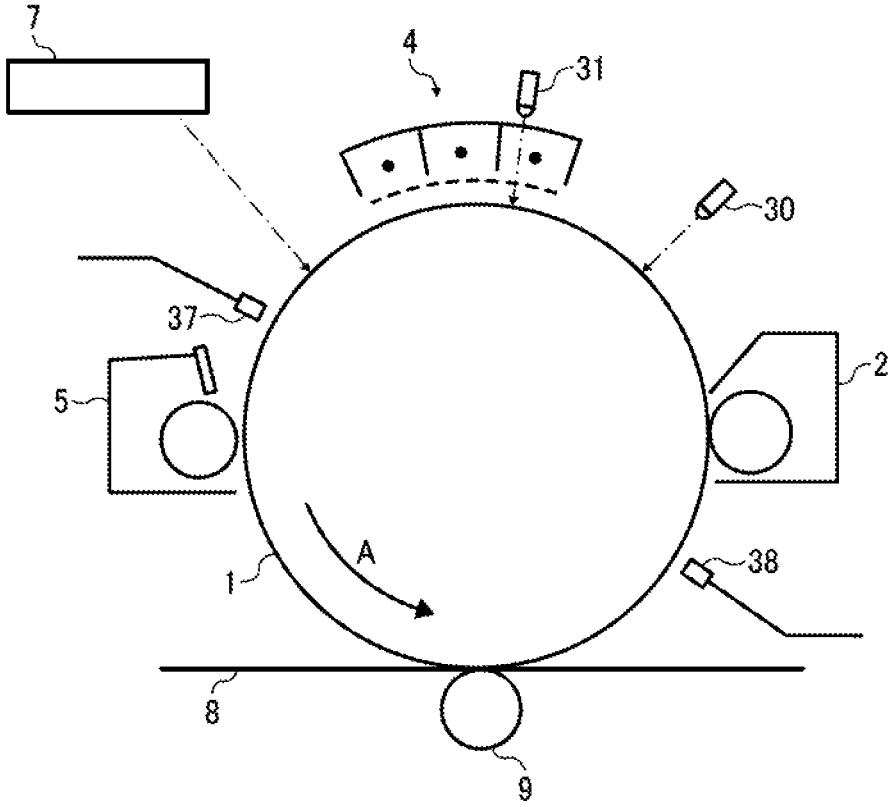
FIG. 2 is a diagram schematically illustrating an exemplary configuration of a toner image forming unit included in the printer of FIG. 1 according to one embodiment of the present invention.

FIG. 2 schematically illustrates a configuration of the toner image forming unit 6. Here, because configurations of the toner image forming units 6Y, 6M, 6C, and 6K are all common, signs Y, M, C, and K indicating respective colors are omitted in the following description. That is, as shown there, in the toner image forming unit 6, an electric charging unit 4, an exposing device 7, a developing device 5, a primary transfer bias roller 9, and a drum cleaning unit 2 or the like are sequentially disposed in this order in a rotational direction of the rotary photoconductor 1 as shown by arrow A in the drawing. The toner image forming unit 6 integrally constitutes a process cartridge together with at least one of the rotary photoconductor 1, the drum cleaning unit 2, an electric charge removing device, the electric charging unit 4, and the developing device or the like. The toner image forming unit 6 is configured to be removable from the printer 100. A specific configuration of the electric charging unit 4 is described later in greater detail. Between the drum cleaning unit 2 and the electric charging unit 4, a second erase lamp 30 (i.e., one of second erase lamps 30Y, 30M, 30C, and 30K as shown in FIG. 1) is disposed as a second electric charge removing device. A first surface potential sensor 37 (i.e., one of first surface potential sensors 37Y, 37M, 37C, and 37K as shown in FIG. 1) is disposed between the exposing unit 7 and the developing device 5 to detect a surface potential of the rotary photoconductor 1 right after the electric charging unit 4 completes a discharging process. A second surface potential sensor 38 (i.e., one of second surface potential sensors 38Y, 38M, 38C, and 38K as shown in FIG. 1) is also disposed between the primary transfer bias roller 9 and the drum cleaning unit 2 while facing a surface of the rotary photoconductor 1 to detect a surface potential of the rotary photoconductor 1 right after the electric charging unit 4 completes a primary transfer process.

Now, a basic operation to form a toner image is described herein below with reference back to FIG. 1. Again, since the basic operation to produce the toner images of Y, M, C, and K colors are substantially the same, an operation to produce a Y toner image is typically described herein below. That is, initially, a drive device, not shown, rotates the rotary photoconductor 1Y counterclockwise in the drawing. At the same time, the electric charging unit 4Y uniformly charges a surface of the rotary photoconductor 1Y rotated counterclockwise in the drawing. The uniformly charged surface of the rotary photoconductor 1Y is then subjected to scanning exposure of a laser light beam thereby bearing a Y color electrostatic latent image thereon. The Y color electrostatic latent image is then developed and visualized to be a Y toner image by the developing device 5Y with Y toner, and is then intermediately transferred onto the intermediate transfer belt 8 during an intermediate transfer process. Toner remaining on the surface of the rotary photoconductor 1Y after the intermediate transfer process is removed by the drum cleaning unit 2Y. Further, a residual charge remaining on the surface of the rotary photoconductor 1Y after the cleaning process is also removed by the electric charge removing device to initialize the surface thereof to prepare for the next image formation. A process of diselectrifying the surface of the rotary photoconductor 1Y with the electric charge removing device is described later in greater detail.

In the other toner image forming units 6M, 6C, and 6K than that of 6Y, toner images of M, C, and K colors are similarly formed on the respective rotary photoconductors 1M, 1C, and 1K and are intermediately transferred and superimposed on the intermediate transfer belt 8, sequentially. Here, the exposing devices 7Y, 7M, 7C, and 7K acting as electrostatic latent image formation systems execute scanning exposure by irradiating laser light beams and form respective electrostatic latent images on the surfaces of the rotary photoconductors 1 provided in the toner image forming units 6 based on image information.

Further, below the toner image forming units 6Y, 6M, 6C, and 6K in the drawing, an intermediate transfer unit 15 is disposed, in which an intermediate transfer belt 8 acting as an intermediate transfer member is stretched and is endlessly moved. The intermediate transfer unit 15 includes four primary transfer bias rollers 9Y, 9M, 9C, and 9K and a belt cleaning unit beside the intermediate transfer belt 8. The intermediate transfer unit 15 also includes a secondary transfer backup roller 12. The intermediate transfer belt 8 is endlessly moved clockwise in the drawing.

The primary transfer bias rollers 9Y, 9M, 9C, and 9K and the rotary photoconductors 1Y, 1M, 1C, and 1K sandwich the above-described endlessly moving intermediate transfer belt 8 while creating respective primary transfer nips therebetween. The primary transfer bias rollers 9Y, 9M, 9C, and 9K apply transfer biases having reverse polarities (e.g., positive polarities) to that of toner to respective backside portions of the intermediate transfer belt 8 (i.e., an inner circumferential surface of a loop of the intermediate transfer belt 8). All of remaining rollers other than the primary transfer bias rollers 9Y, 9M, 9C, and 9K are electrically grounded.

As the intermediate transfer belt 8 endlessly moves and passes through the primary transfer nips of Y, M, C, and K colors, sequentially, toner images of Y, M, C, and K colors borne on the respective rotary photoconductors 1Y, 1M, 1C, and 1K are superimposed one after another during the primary transfer process. With this, a four color (i.e., a full-color) superimposed toner image (hereinafter simply referred to as a four color toner image) is formed on the intermediate transfer belt 8. Further, the above-described secondary transfer backup roller 12 and a secondary transfer roller 19 sandwich the intermediate transfer belt 8 and form a secondary transfer nip therebetween. Hence, the four color (i.e., the full-color) toner image formed on the intermediate transfer belt 8 is secondarily transferred onto a transfer sheet P as a recording medium in the secondary transfer nip.

On a section of the intermediate transfer belt 8, which has passed through the secondary transfer nip, transfer residual toner not transferred onto the transfer sheet P remains. However, the transfer residual toner is then removed by the belt cleaning unit 10 disposed downstream of the secondary transfer nip in a moving direction of the intermediate transfer belt 8. Here, in the secondary transfer nip, the transfer sheet P is sandwiched and conveyed by the intermediate transfer belt 8 and the secondary transfer roller 19 with each of the surfaces of those moving in the same direction. The four color (i.e., a full-color) toner image transferred onto the surface of the transfer sheet P is then fixed under heat and pressure when the transfer sheet P is sent from the secondary transfer nip and traverses between two rollers provided in the fixing device 20.

Figure 3:
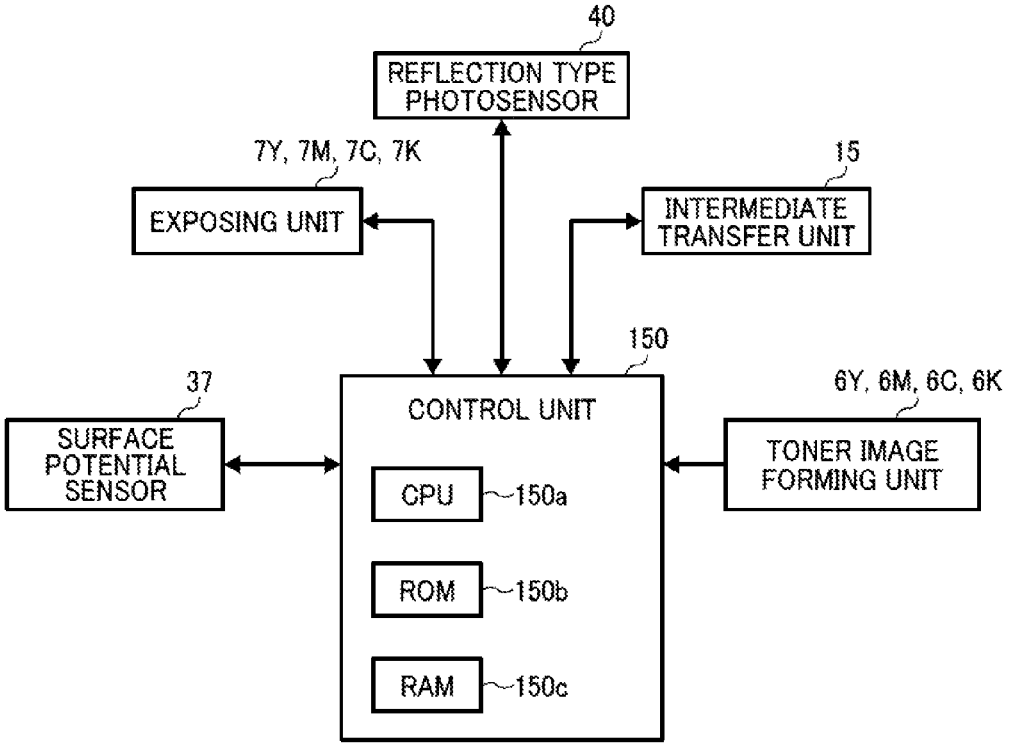
FIG. 3 is a block diagram schematically illustrating an exemplary control system included in the printer of FIG. 1 according to one embodiment of the present invention.

FIG. 3 is a block diagram showing an exemplary configuration of a control system employed in the printer 100. The above-described toner image forming units 6Y, 6M, 6C, and 6K, the exposing devices 7Y, 7M, 7C, and 7K, the intermediate transfer unit 15, the first surface potential sensor 37, and a reflection type photosensor 40 (i.e., an electronic component that detects the presence of visible light, infrared transmission (IR), and/or ultraviolet (UV) energy) are electrically connected to the control unit 150 to be controlled. The control unit 150 includes a microcomputer, for example, that includes a CPU (Central Processing Unit) 150*a* , a ROM (Read Only Memory) 150*b* , a RAM (Random Access Memory) 150*c* , and an input/output interface or the like. Operation of all of the toner image forming units 6Y, 6M, 6C, and 6K, the exposing devices 7Y, 7M, 7C, and 7K, the intermediate transfer unit 15, and the reflection type photosensor 40 is controlled as described below. That is, the CPU 150*a* runs control program stored in the ROM 150*b* using the RAM 150*c* as a work area.

In the printer 100, so-called process control is executed by the control unit 150, for example, all of when a main power is applied thereto, when the printer 100 enters a standby state after a specified time has elapsed, and when a given number of sheets has been printed or the like. Image density gradation adjustment control is executed in the process control as described below in greater detail.

That is, first of all, the reflection type photosensor 40 is calibrated at a prescribed time for executing the process control. As the calibration of it, the reflection type photosensor 40 is operated when a toner image is not formed on the intermediate transfer belt 8, and a quantity of light emitted from a light emitting source is gradually changed to seek a prescribed light emitting amount that generates a prescribed level of a detection voltage. The light emitting amount sought in this calibration is then stored in the RAM (Random Access Memory) 150*c* in the control unit 150, for example, and is used later in adjusting an image density.

Subsequent to the calibration of the reflection type photosensor 40, ten toner patches (hereinafter a unit of these ten toner patches is simply reference to as a gradation test pattern), for example, are formed on each of the surfaces of the rotary photoconductors 1Y, 1M, 1C, and 1K as a test toner image under a different image formation condition (e.g., a developing potential) that differentiates a toner adhering amount from each other. That is, when the gradation test pattern is formed, in the first place, each of the rotary photoconductors 1Y, 1M, 1C, and 1K in the respective toner image forming units 6Y, 6M, 6C, and 6K is electrified. However, a charging manner employed here is different from when rotary photoconductors are uniformly charged in an ordinary image formation (for example, about −700 volts), such that each of surface potentials of the respective rotary photoconductors 1Y, 1M, 1C, and 1K increasingly grows one after another in accordance with an arrangement position of the respective rotary photoconductors 1Y, 1M, 1C, and 1K under control of the control unit 150. Subsequently, under control of the control unit 150 again, the exposing devices 7Y, 7M, 7C, and 7K emit laser light beams to scan the surfaces of the rotary photoconductors 1Y, 1M, 1C, and 1K, respectively, thereby forming electrostatic latent images of the gradation test patterns on the respective rotary photoconductors 1Y, 1M, 1C, and 1K. Subsequently, the electrostatic latent images of the gradation test patterns are developed by the developing devices 5Y, 5M, 5C, and 5K. Hence, the multiple gradation test patterns having respective component colors are formed on the rotary photoconductors 1Y, 1M, 1C, and 1K, respectively. Again, during the developing processes, the control unit 150 increasingly or decreasingly applies prescribed developing biases to the respective developing rollers of the developing devices 5Y, 5M, 5C, and 5K one after another as well.

Subsequently, a quantity of reflected light of each of the gradation test patterns of respective colors formed on the intermediate transfer belt 8 is detected by the reflection type photosensor 40 when each of these gradation test patterns passes through the reflection type photosensor 40 as the intermediate transfer belt 8 endlessly moves. Subsequently, the reflection type photosensor 40 outputs electrical signals to the control unit 150 in accordance with a density of each of the toner patches of the gradation test patterns of respective colors. The control unit 150 then seeks a toner adhering amount of each of the toner patches of the gradation test pattern of respective colors based on the output signals sequentially transmitted from the reflection type photosensor 40. The control unit 150 then stores the toner adhering amounts of the toner patches of the gradation test pattern of respective colors in the RAM 150*c* . Together with the toner adhering amounts, the control unit 150 also stores developing potentials to form the gradation test patterns, which are estimated based on the image formation conditions used in forming the gradation test patterns of respective colors, in the RAM 150*c* . The gradation test patterns of respective colors are removed by the belt cleaning unit 10 after passing through a position facing the reflection type photosensor 40.

Figure 4:
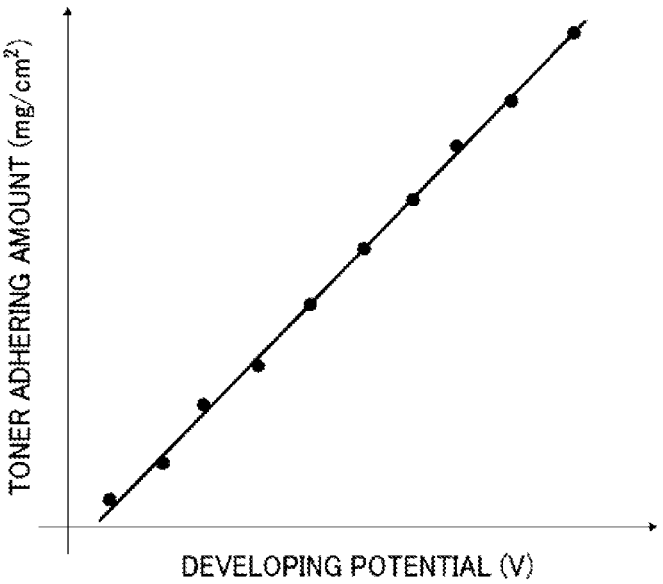
FIG. 4 is a chart schematically illustrating an exemplary relation between a developing potential and a toner adhering amount according to one embodiment of the present invention.

FIG. 4 is a diagram illustrating relations between a developing potential to form each of toner patches which collectively constitute a gradation test pattern and a toner adhering amount. That is, the diagram is obtained by plotting the above-described relations. As shown in FIG. 4, a horizontal axis represents a developing potential V (i.e., a difference between a developing bias VB and a potential VL of a pattern image), while a vertical axis indicates a toner adhering amount per unit area [$mg/cm^2$]. For each of the respective colors, the control unit 150 chooses a straight line section in data as plotted in FIG. 4, and calculates and seeks a linear equation by applying collinear (i.e., straight line) approximation to the data in the straight line section using a least-squares method. Subsequently, the control unit 150 further calculates a developing potential base on the linear equation capable of obtaining a target toner adhering amount, and adjusts the image formation condition (e.g., power of a LD (Laser Diode), a charging bias, a developing bias) to realize the developing potential.

Figure 5:
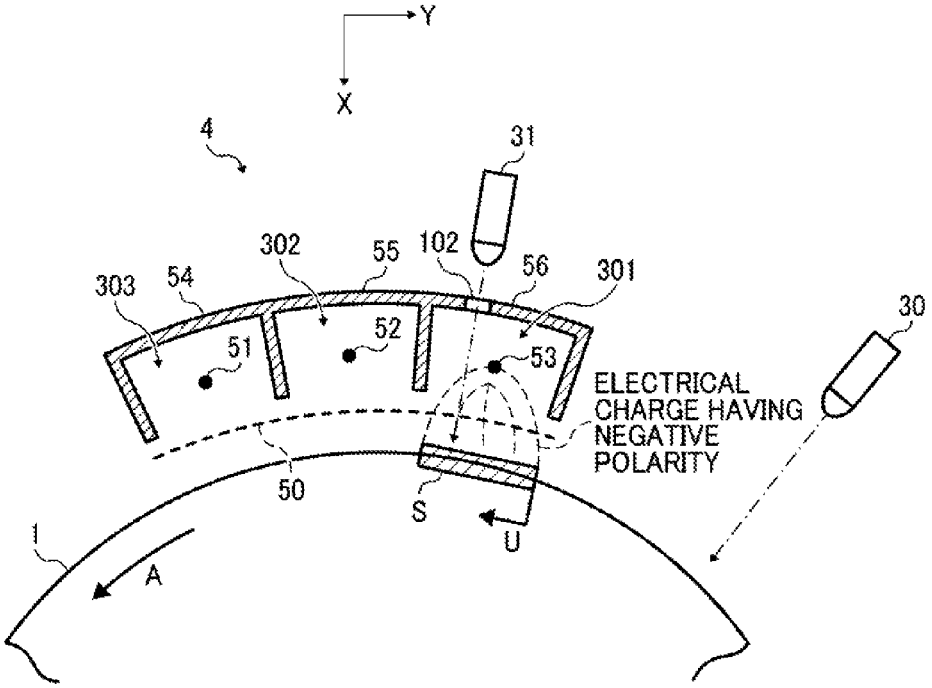
FIG. 5 is an enlarged view illustrating an exemplary surrounding area of an electric charging unit provided in the toner image forming unit of FIG. 2 according to one embodiment of the present invention.
Figure 6:
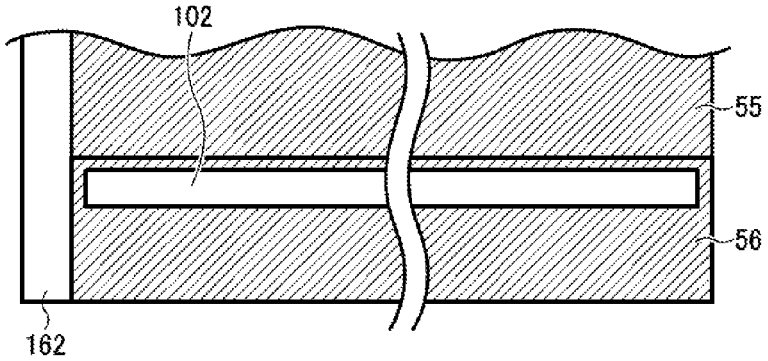
FIG. 6 is a view illustrating the electric charging unit of FIG. 5 when taken from above the electric charging unit in a direction X.
Figure 7A:
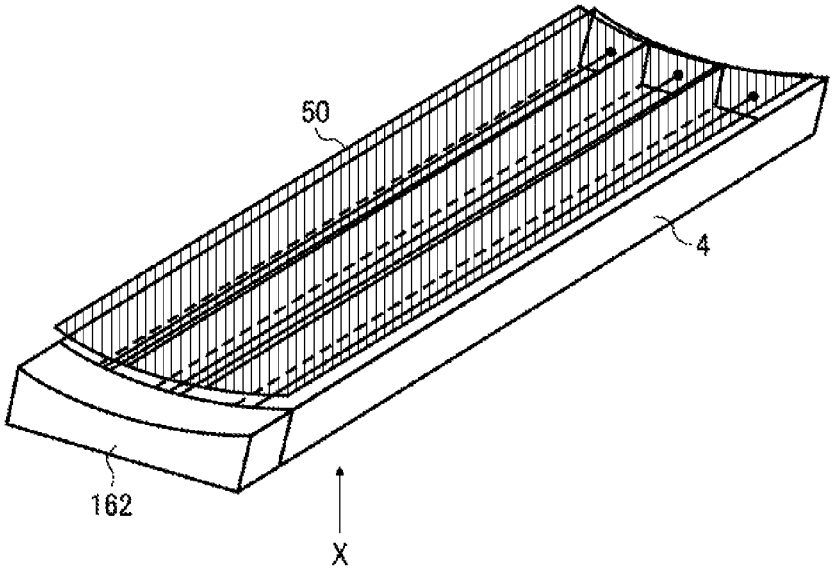
FIGS. 7A and 7B are views collectively illustrating the electric charging unit of FIG. 5 when taken from blow the electric charging unit in an opposite direction to that of X.
Figure 7B:
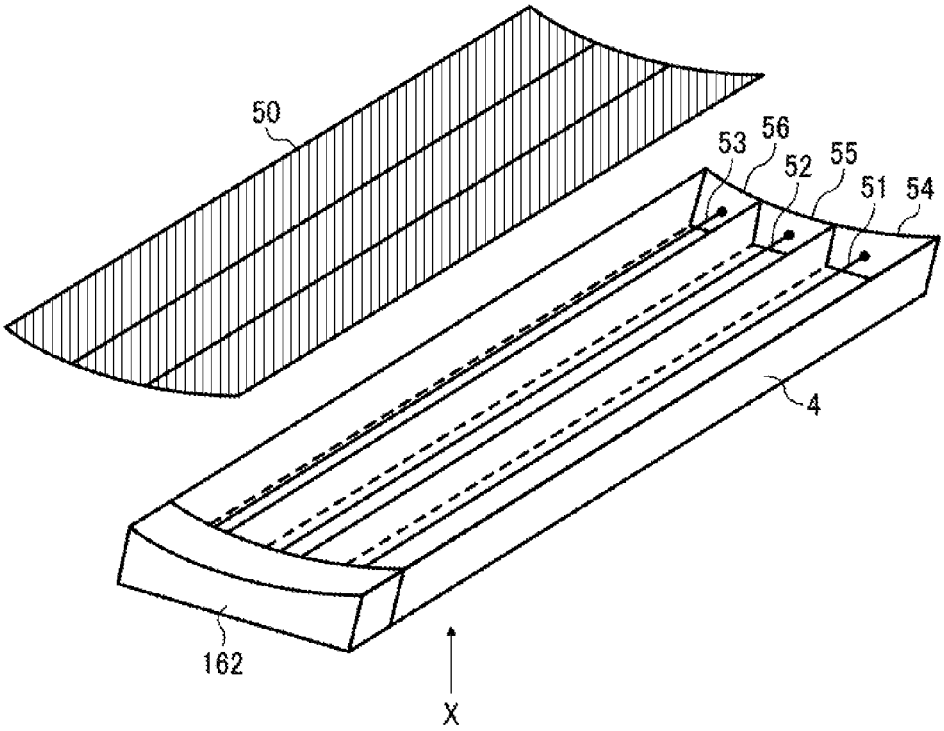

Now, a configuration of an electric charging unit 4 as a unique feature of the first embodiment this printer is described with reference to FIGS. 5 to 7. Because, all of the electric charging units 4Y, 4M, 4C, and 4K are composed of common configuration, signs of Y, M, C, and K are omitted herein below in the description. FIG. 5 is an enlarged view illustrating a surrounding area of the electric charging unit 4. FIG. 6 is a view schematically illustrating the electric charging unit 4 of FIG. 5 when taken from thereabove in a direction X. FIGS. 7A and 7B are views collectively illustrating the electric charging unit 4 of FIG. 5 when taken from therebelow in an opposite direction to the above-described direction X. As shown in FIG. 5, the electric charging unit 4 of this printer includes a scorotron charger including three electric discharge wires 51, 52, and 53 in a housing thereof with a grid 50 that controls a surface potential of the rotary photoconductor. In the following description, when these electric discharge wires 51, 52, and 53 are to be distinguished from the other, the electric discharge wire 53 located upstream most in a surface moving direction of the rotary photoconductor is referred to as a first electric discharge wire 53, the second electric discharge wire 52 located at a center therebetween is referred to as a second electric discharge wire 52, and the electric discharge wire 3 located downstream most in the surface moving direction of the rotary photoconductor is referred to as a third electric discharge wire 51. FIG. 7A indicates an aspect of the scorotron charger with the grid 50 mounted thereon. By contrast, FIG. 7B indicates an aspect of the scorotron charger with the grid 50 dismounted therefrom. To enhance stability of electric discharging of the scorotron charger, the electric discharge wires 51, 52, and 53 are shielded by first to third metal electric discharge shields 56, 55, and 54, respectively. These electric discharge shields 56, 55, and 54, integrally constitute the housing of the electric charging unit 4. In the following description, when these electric discharge shields 56, 55, and 54, are to be distinguished from the other, the first electric discharge shield 56 to shield the first electric discharge wire 53 is referred to as a first electric discharge shield 56, the second electric discharge shield 55 to shield the second electric discharge wire 52 is referred to as a second electric discharge shield 55, and the third electric discharge shield 54 to shield the third electric discharge wire 53 is referred to as a third electric discharge shield 54. Further, a space defined by the first electric discharge shield 56 enclosing the first electric discharge wire 53 is referred to as a first electric charging section 301, a space defined by the second electric discharge shield 55 enclosing the second electric discharge wire 52 is referred to as a second electric charging section 302, and a space defined by the third electric discharge shield 54 enclosing the third electric discharge wire 51 is referred to as a third electric charging section 303. As shown in FIG. 5, the pre-electric charge removal electric charging process is implemented by the first electric discharge wire 53 located upstream most among the three electric discharge wires in the rotational direction of the rotary photoconductor as shown by arrow A in the drawing. However, at least one electric discharge wire needs to be employed to form an image in the electric charging unit 4 beside an electric discharge wire that executes the pre-electric charge removal electric charging process. That is, the number of electric discharge wires employed in the electric charging unit 4 is not limited to three. Specifically, the number of electric discharge wires may be two and four or more. Further, as shown in FIG. 6, in the first electric discharge shield 56 located above the first electric discharge wire 53, an opening 102 is provided. Above the opening 102, a first erase lamp 31 (i.e., one of first erase lamps 31Y, 31M, 31C, and 31K in FIG. 1) is disposed as a first electric charge removing device as shown in FIGS. 2 and 5.

Figure 8A:
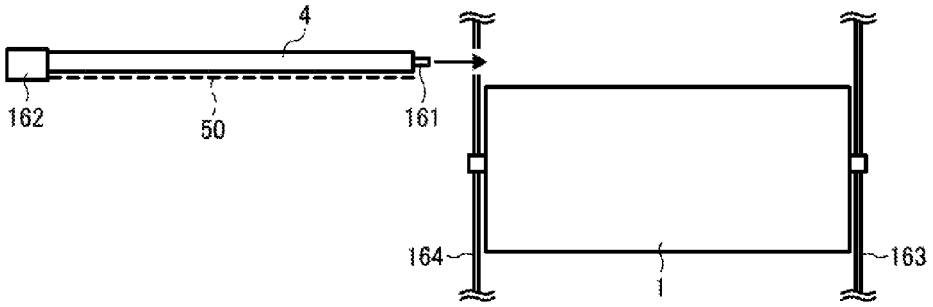
FIGS. 8A and 8B are diagrams collectively illustrating an exemplary aspect of the electric charging unit of FIG. 5 when the electric charging unit is attached and detached to and from the printer of FIG. 1 according to one embodiment of the present invention.
Figure 8B:
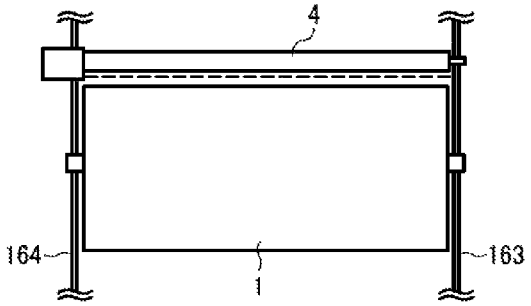

FIGS. 8A and 8B are diagrams that collectively illustrate an aspect of the electric charging unit 4 when the electric charging unit 4 is detached from and attached to the process cartridge. Specifically, FIG. 8A illustrates an aspect of the electric charging unit 4 before the electric charging unit 4 is attached to the process cartridge. By contrast, FIG. 8B illustrates an aspect of the electric charging unit 4 when it has been attached thereto. A pair of securing members 161 and 162 is provided at both ends of the electric charging unit 4 in an axial direction of the rotary photoconductor 1, respectively. Specifically, as shown in FIG. 8B, the pair of securing members 161 and 162 is engaged with a pair of frame members 163 and 164 provided in the process cartridge, respectively, so that the electric charging unit 4 can be fixed to the process cartridge.

Figure 9A:
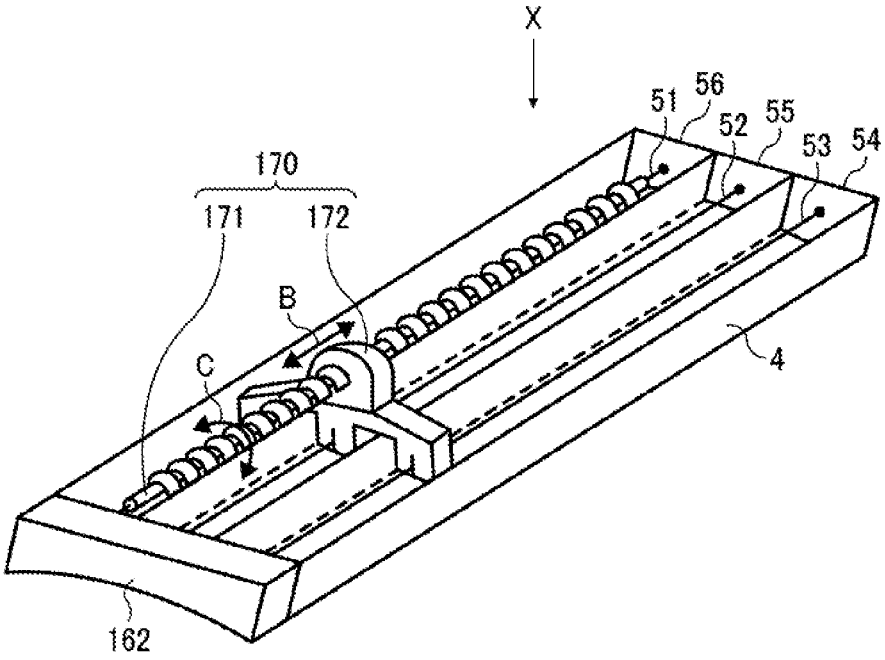
FIGS. 9A and 9B are diagrams collectively illustrating an exemplary electric charging unit cleaning mechanism to clean an electric discharge wire included in the electric charging unit according to one embodiment of the present invention.
Figure 9B:
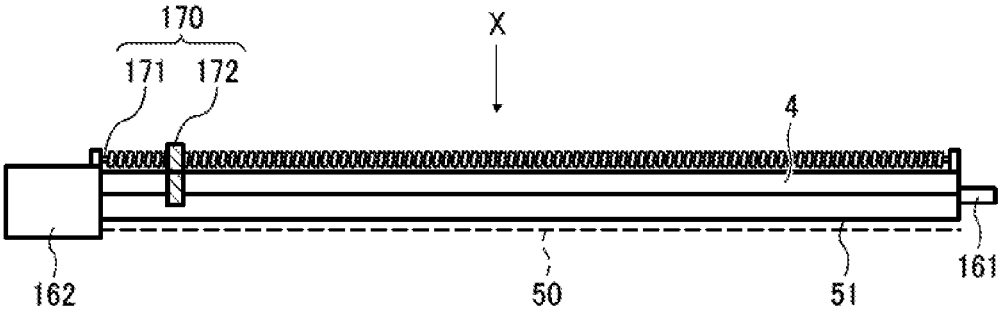

The electric charging unit 4 also includes an electric charging unit cleaning mechanism 170 as a cleaning unit to clean the electric discharge wire. That is, electric discharge products generally occurs during execution of the electric discharge process and adheres to each of the electric discharge wires 51, 52, and 53, thereby likely causing poor electric discharging when left intact. Subsequently, the electric charging unit cleaning mechanism automatically cleans each of the electric discharge wires 51, 52, and 53 on a regular basis, so that defective electric discharge generally caused by the electric discharge products may be prevented. FIGS. 9A and 9B are diagrams that collectively illustrate the electric charging unit cleaning mechanism 170 in more detail. FIG. 9A illustrates the electric charging unit cleaning mechanism 170 when viewed from a direction shown by arrow X in FIG. 5. FIG. 9B also illustrates the electric charging unit cleaning mechanism 170 when viewed from a direction shown by arrow Y in FIG. 5. As shown there, the electric charging unit cleaning mechanism 170 includes a cleaning member 172 to clean the electric discharge wires 51, 52 and 53 by moving long above the electric discharge wires 51, 52 and 53. The electric charging unit cleaning mechanism 170 also includes a drive shaft 171 composed of a ball screw or the like to allow movement of the cleaning member 172. The cleaning member 172 includes a through hole with a thread tapping part to mate with the drive shaft 171. Hence, when the drive shaft 171 is driven and rotated in a direction shown by arrow C in the drawing, the cleaning member 172 slides in a direction shown by arrow B in the drawing.

Figure 10:
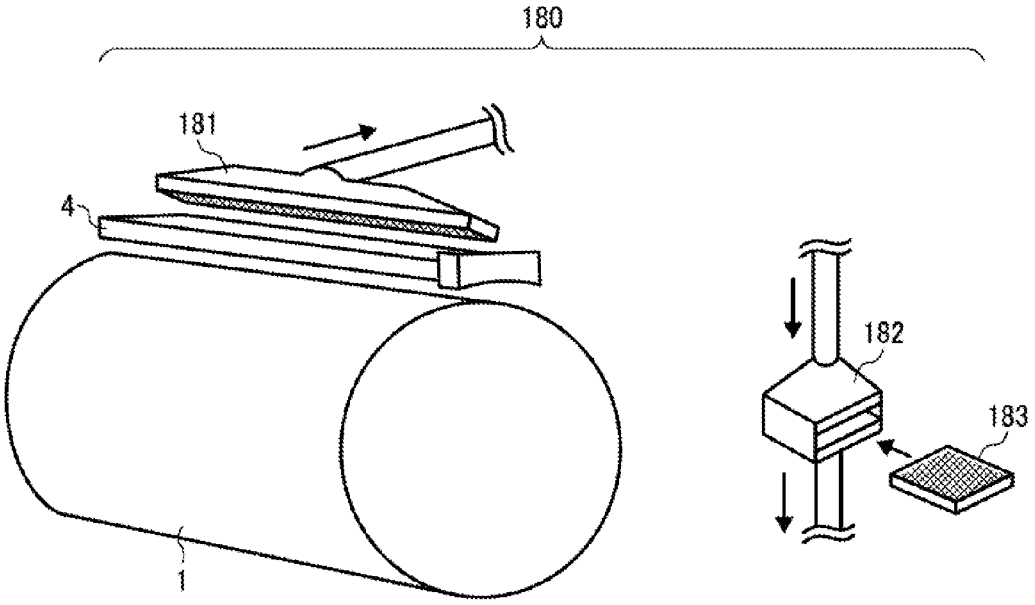
FIG. 10 is a diagram illustrating an exemplary ozone treatment system to treat ozone generated when the electric charging unit operates according to one embodiment of the present invention.

In the vicinity of the electric charging units 4, an ozone treatment system 180 as a zone treatment device is disposed as shown in FIG. 10. That is, as shown in FIG. 10, the ozone treatment system 180 includes an inlet duct 181 and an intermediate duct 182 accommodating an ozone filter 183 therein. The ozone treatment system 180 captures air existing around the electric charging units 4 through the inlet duct 181 together with ozone generated when the electric discharge wires 51, 52, and 53 are operated. The ozone treatment system 180 then reduces a density of the ozone to an acceptable level by passing the air with ozone through the ozone filter 183.

Further, as shown in FIG. 5, the first erase lamp 31 is disposed above a prescribed position of the surface of the rotary photoconductor 1, so that electric charge removing light irradiated therefrom arrives at a position downstream of an upstream most position in a region (i.e., a region S in the drawing) thereof, on which electric charge having a negative polarity generated by the first electric discharge wire 53 located upstream most in the rotational direction of the rotary photoconductor 1 (as shown by arrow A in the drawing) pours. For example, as shown in FIG. 5, the first erase lamp 31 is disposed downstream of the first electric discharge wire 53 in the rotational direction of the rotary photoconductor 1 as shown by arrow A in the drawing. However, the position the first erase lamp 31 is not limited to this, and it can be located upstream of the first electric discharge wire 53 in the rotational direction of the rotary photoconductor 1 as well as long as the electric charge removing light emitted from the erase lamp 31 arrives at a position of the surface of the rotary photoconductor 1 downstream of a position indicated by the arrow U in the drawing in the rotational direction of the rotary photoconductor 1 (i.e., arrow A in the drawing).

Figure 11A:
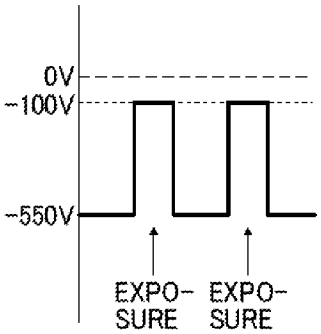
FIGS. 11A to 11C are charts collectively illustrating an exemplary change in a surface potential of the rotary photoconductor as a comparative example.
Figure 11B:
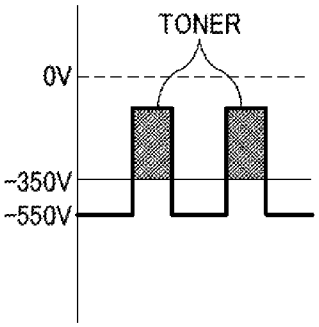
Figure 11C:
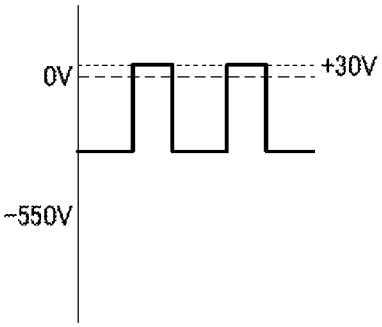

Now, a phenomenon in which a polarity of a surface potential of the rotary photoconductor 1 acting as an electrostatic latent image bearer changes after completion of a transfer process, which is a factor to cause an afterimage, is described with reference to FIGS. 11A to 11C. FIGS. 11A to 11C are charts collectively illustrating an exemplary change in a surface potential of the rotary photoconductor 1 occurring when an electrostatic latent image is formed, the electrostatic latent image is developed, and a toner image is transferred, respectively. Specifically, as shown in FIG. 11A, the rotary photoconductor 1 has a surface potential of −550 volts after the rotary photoconductor 1 is uniformly charged. A potential of a portion exposed by the exposing device 7 as an optical writing device becomes approximately −100 volts when an electrostatic latent image is formed. As shown in FIG. 11B, during a developing process, some toner adheres to the exposed surface portion of the rotary photoconductor 1 due to an electric field caused by a developing potential (−250 volts), which is a difference in potential between the developing bias (−350 volts in the drawing) and the surface voltage of the exposed portion (approximately −100 volts in the drawing) of the rotary photoconductor 1. Further, in a transfer process implemented subsequent to the developing process, the primary transfer bias roller 9 as a transfer device positively charges the intermediate transfer belt 8 with electricity to transfer the toner image from the surface of the rotary photoconductor 1 onto the intermediate transfer belt 8. In the transfer process, since the positively charged intermediate transfer belt 8 with electricity contacts the rotary photoconductor 1, the positive electric charge is accordingly provided to the surface of the rotary photoconductor 1 as well. Therefore, as shown in FIG. 11C, the surface potential of the rotary photoconductor 1 existing after completion of the transfer process shifts to a positive side as a whole, and the potential of the exposed surface portion of the rotary photoconductor 1 exceeds 0 volts and further grows to a higher level (+30 volts in the drawing). That is, when the exposed portion of the negatively charged surface of the rotary photoconductor 1 has an insufficient potential on the negative polarity side, a polarity of the surface potential of the exposed portion of the rotary photoconductor 1 is easily reversed to the positive polarity side after completion of the transfer process.

In general, a residual charge remaining after completion of a transfer process on the surface of the rotary photoconductor 1 is removed to level a difference in potential between unexposed and exposed portions on the surface of the rotary photoconductor 1. When an electric charge removing device emits electric charge removing light to a surface of e rotary photoconductor, a positive electric charge is generated in an electric charge generation layer (herein after simply referred to as a CGL) in the rotary photoconductor 1 and neutralizes the residual electric charge of the negative polarity thereby removing the electricity (i.e., the electric charge) therefrom. However, in a portion of the rotary photoconductor 1 where the surface potential is reversed to the positive polarity from the negative polarity, neutralization of the residual electric charge does not occur and the residual charge having a positive polarity remains, even if the electric charge removing device irradiates the portion of the rotary photoconductor 1 with the electric charge removing light. Thus, even if the electric charging unit 4 electrifies the surface of the rotary photoconductor on the condition that the electric charge having the positive polarity remains on the surface of the rotary photoconductor 1, the surface thereof cannot uniformly bear a negative potential thereon. That is, the surface portion of the rotary photoconductor 1 having the positive potential after completion of the transfer process cannot bear an intended potential, but has a positive potential greater than that existing elsewhere after the surface of the rotary photoconductor 1 is electrified. Thus, when the portion that has a positive potential greater than elsewhere after the surface of the rotary photoconductor is electrified is exposed, since a developing potential as a difference between a potential of the exposed portion thereof and a developing bias unnecessarily grows, toner unnecessarily adheres to this portion, and accordingly a dark toner image is formed as shown in FIG. 4 thereby generating an afterimage as a result. To prevent the afterimage, the surface portion of the rotary photoconductor 1 with the residual charge of the positive polarity needs to be once electrified in a negative polarity to remove the remaining charge thereafter as described above. It is noted here that, even when a polarity of the surface of the rotary photoconductor 1 is opposite to the above-described electric charge polarity thereof in a system, the system yet operates on the same principle except that a positive polarity is replaced with a negative polarity vice versa.

Figure 12A:
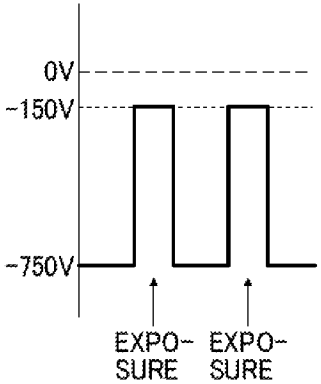
FIGS. 12A to 12C are charts collectively illustrating another exemplary change in a surface potential of the rotary photoconductor as another comparative example.
Figure 12B:
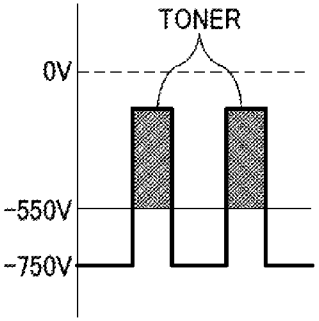
Figure 12C:
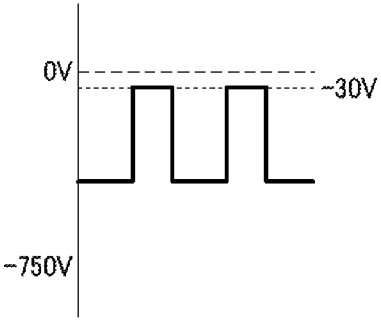

By contrast, when the exposed surface portion of the rotary photoconductor 1 has a sufficiently great potential of the negative polarity, the surface potential of the exposed portion of the rotary photoconductor 1 keeps the negative polarity even after completion of the transfer process. That is, as shown in FIGS. 12A to 12C, which collectively illustrate another exemplary change in a surface potential generated on a surface of the rotary photoconductor 1 at times when an electrostatic latent image is formed, the electrostatic latent image is developed, and a toner image has been transferred, a surface of the rotary photoconductor 1 is uniformly charged to bear a potential of −750 volts (see FIG. 12A). A potential of a portion of the rotary photoconductor 1 exposed by the exposing device 7 is approximately −150 volts when an electrostatic latent image is formed. Subsequently, as shown in FIG. 12B, during a developing process, some toner adheres to the exposed surface portion of the rotary photoconductor 1 due to an electric field caused by a developing potential (−400 volts), which is a difference in potential between a developing bias (−550 volts in the drawing) and the surface potential of the exposed portion (approximately −150 volts in the drawing) of the rotary photoconductor 1. In a transfer process executed subsequent to the developing process, the primary transfer bias roller 9 as a transfer device positively charges the intermediate transfer belt 8 with electricity to transfer the toner image from the surface of the rotary photoconductor 1 onto the intermediate transfer belt 8. In the above-described transfer process, since the positively charged intermediate transfer belt 8 contacts the rotary photoconductor 1, a positive charge is accordingly provided to the surface of the rotary photoconductor 1 as well. Hence, as shown in FIG. 12C, although the surface potential of the rotary photoconductor 1 existing after completion of the transfer process shifts to a positive side as a whole, the potential of the exposed surface portion of the rotary photoconductor 1 does not exceed 0 volts while keeping the negative potential (i.e., −30 volts in the drawing). When the surface of the rotary photoconductor 1 has the negative potential in this way and the electric charge removing device irradiates electric charge removing light thereto, residual charge remaining thereon can be removed. Accordingly, the pre-electric charge removal electric charging process is not required. It is noted here that, even when a polarity of the surface of the rotary photoconductor 1 is opposite to the above-described electric charge polarity thereof in a system, the system yet operates on the same principle except that a positive polarity is replaced with a negative polarity vice versa.

Now, an electric charge removing process executed in one embodiment of the present invention is herein below described. When the process control is executed as described earlier, the control unit 150 compares an absolute value of a potential generated in an exposed surface portion of the rotary photoconductor 1 and detected by the first surface potential sensor 37 with a prescribed first threshold value. The first threshold value is determined and obtained in the below described manner. Initially, a relation between a potential of an exposed surface portion of the rotary photoconductor 1 existing before executing a transfer process and that existing after completion of the transfer process is previously investigated. Subsequently, based on the relation, an absolute value of the potential existing before executing the transfer process which causes the potential existing after completion of the transfer process to have a positive polarity across the 0 volts is sought. Subsequently, the first threshold value is determined by adding a prescribed margin to the absolute value of the potential existing before executing the transfer process.

Hence, when the absolute value of the potential of the exposed surface portion of the rotary photoconductor 1 is less than the first threshold value, a potential existing on the exposed surface portion of the rotary photoconductor 1 after completion of the transfer process is highly likely reversed to have a positive polarity. Subsequently, the control unit 150 determines that an afterimage is easily formed in this situation and controls the erase lamp 31 to operate (i.e., emit electric charge removing light). Specifically, first of all, the second erase lamp 30 irradiates the surface of the rotary photoconductor 1 with the light. Subsequently, the first electric discharge wire 53 that acts as an electric charging unit to execute the pre-electric charge removal electric charging process applies an electric charge having a negative polarity onto a surface portion of the rotary photoconductor 1, in which the surface potentials has a positive polarity and an electric charge is not removed therefrom even by irradiation of the second erase lamp 30. That is, after the potential of the surface portion of the rotary photoconductor 1 having the positive polarity is shifted therefrom to a negative side, the first erase lamp 31 is emitted. Here, when the first electric discharge wire 53 applies an electric charge of the negative polarity to the surface of the rotary photoconductor 1, the first erase lamp 31 may irradiate the surface of the rotary photoconductor 1 with light at the same time as well.

That is, when he described phenomenon, in which the polarity of the electric charge of the exposed surface portion of the rotary photoconductor 1 existing after completion of the transfer process becomes opposite to the electrified polarity, occurs as earlier, the electric charge removing light is irradiated onto the surface of the rotary photoconductor 1 from the erase lamp 31 after the surface of the rotary photoconductor 1 is subjected to the pre-electric charge removal electric charging process to flatten the surface potential of the rotary photoconductor 1. Further, since the second and third electric discharge wires 52 and 51 which uniformly charge the surface of the rotary photoconductor 1 and the first electric discharge wire 53 that executes the pre-electric charge removal electric charging process are integrally accommodated in the housing, the electric charging unit that executes the pre-electric charge removal electric charging process does not need to be separately disposed from the electric charging unit that uniformly charges the surface of the rotary photoconductor 1 to form an image. Hence, multiple electric charging unit cleaning mechanisms and multiple ozone treatment systems are not needed in the image forming apparatus. However, the electric charging unit is one of consumables and needs a periodic replacement with a new electric charging unit. That is, in a comparative system, in which an electric charging unit that executes the pre-electric charge removal electric charging process is separately employed from an electric charging unit that uniformly charges the surface of the rotary photoconductor 1 with electricity to form an image, since replacement of each of the electric charging units is frequently needed, maintenance performance of the image forming apparatus is degraded. By contrast, since the electric charging unit that executes pre-electric charge removal electric charging process is contained inside the housing of the electric charging unit 4, maintenance performance of the image forming apparatus is more upgraded in comparison with the comparative configuration as well.

Meanwhile, when the absolute value of the potential of the exposed surface portion of the rotary photoconductor 1 is greater than the first threshold value, only the second erase lamp 30 may operate to irradiate light while inhibiting the first erase lamp 31 to operate. In general, when the number of irradiation from an erase lamp is increased, the life of the rotary photoconductor 1 is disadvantageously shortened due to light fatigue. Hence, the rotary photoconductor 1 can be prevented from shortening the life thereof when the number of times of irradiation from the erase lamp is appropriately reduced to the minimum as required to prevent the afterimage.

Figure 18:
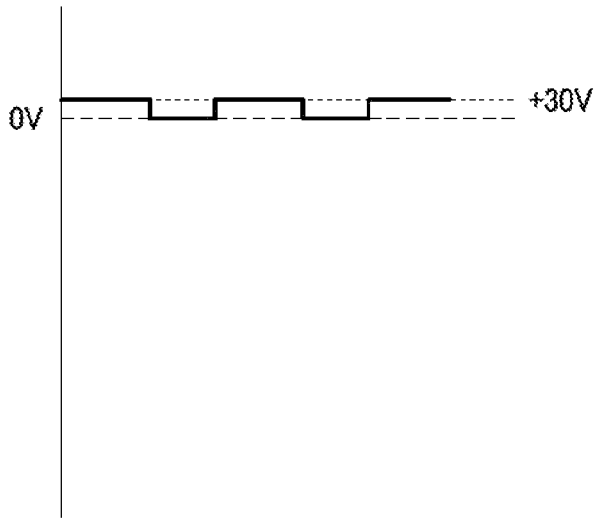
FIG. 18 is a chart illustrating an exemplary surface potential existing on the rotary photoconductor after light irradiation from a second erase lamp as a comparative example.

As described above, when both of the first and second erase lamps 31 and 30 emit the respective light beams, the first electric discharge wire 53 applies the electric charge of the negative polarity to the surface of the rotary photoconductor 1 to change the potential of the surface portion of the rotary photoconductor 1 having the positive polarity from the positive polarity to the negative polarity. At that moment, the surface potential of the rotary photoconductor 1 needs to be shifted by the electric discharge wire 53 to the negative side only by a value capable of cancelling the positive potential generated in the exposed portion while reversing the polarity across the 0 volts. For example, the surface potential of the rotary photoconductor 1 shown in FIG. 11C is changed by irradiation of the second erase lamp 30 to have 0 volts in an unexposed portion and 30 volts in an exposed portion, respectively, as shown in FIG. 18. Thus, the afterimage is not formed, when a portion having the positive potential of 30 volts after the irradiation of the second erase lamp 30 decreases to 0 volts. That is, if the first electric discharge wire 53 lifts the surface potential of the rotary photoconductor by −30 volts, the afterimage is not formed. By contrast, as described earlier with reference to FIG. 11A, when an electrostatic latent image is formed, the surface of the rotary photoconductor needs to be electrified up to −550 volts by the second and third electric discharge wires 52 and 51. As a result, a less amount of electric current needs to be passed through the first electric discharge wire 53 than that passed through the second and third electric discharge wires 52 and 51. For this reason, it is desirable to separately flow electric current through the first electric discharge wire 53 from that passed through the second and third electric discharge wires 52 and 51. That is, a circuit in which the electric current is passed through the first electric discharge wire 53 and that in which the electric current is passed through the second and third electric discharge wires 52 and 51 are separated from each other. With this, the value of electric current to be passed through the first electric discharge wire 53 and that to be passed through second and third electric discharge wires 52 and 51 can be separately set, and are differentiated from the other. Hence, since a minimum electric current necessary to change the surface potential of the rotary photoconductor from about +30 volts to about 0 volts is flown, generation of electric discharge products such as ozone, etc., can be likely suppressed.

Further, as shown in FIG. 11C, when the surface potential of the rotary photoconductor 1 existing after the transfer process shifts to the positive side as a whole, the potential of the unexposed portion has several hundred negative voltages. Thus, the unexposed portion with the −100 volts needs to be diselectrified by the second erase lamp 30 to increase the potential thereof up to 0 volts. Meanwhile, when the minimum necessary electric current is passed through the first electric discharge wire 53 and accordingly the surface potential of the rotary photoconductor is lifted by −30 volts, the unexposed surface portion of the rotary photoconductor 1 has a potential of −30 volts while the exposed portion thereof has the potential of 0 volts. Accordingly, the first erase lamp 31 can sufficiently diselectrifies the rotary photoconductor even with a light quantity capable of desaticizing −30 volts of the unexposed portion. Hence, the first erase lamp 31 may need a light quantity much less than the second erase lamp 30.

Hence, when a minimum electric current necessary to change the surface potential of the rotary photoconductor from about +30 volts to about 0 volts is passed through the first electric discharge wire 53, a light quantity of the first erase lamp 31 is desirably set to be smaller than that of the second erase lamp 30. With this, deterioration of the rotary photoconductor due to light fatigue and accordingly occurrence of the afterimage can be effectively suppressed at the same time as well. Also, because the light quantity of the first erase lamp 31 is set to be relatively small, an amount of electric charge removing light that hits an electric discharge region T1 (see FIG. 19) electrified by the second electric discharge wire 52 can be decreased. With this, decreasing in charging performance of the electric charging unit 4 due to the electric charge removing light emitted from the first erase lamp 31 can be minimized.

Further, when the first erase lamp 31 is operated to emit electric charge removing light as described above, one of the three electric discharge wires (e.g., the first electric discharge wire 53) in the electric charging unit 4 is used as a charger that executes the pre-electric charge removal electric charging process. For this reason, the remaining two electric discharge wires (i.e., the second and third electric discharge wires 52 and 51) charge the rotary photoconductor 1 with electricity in the next image formation process. For this reason, depending on a desired electric charging voltage, the electric charging unit 4 may lack charging performance capable of obtaining the desired electric charging voltage. Subsequently, when the above-described process control is implemented, the control unit 150 compares an absolute value of an electrified potential detected by a first surface potential sensor 37 with the below described second threshold value. Specifically, a prescribed absolute value of the electrified potential which exceeds the charging performance of the electric charging unit 4 when a default value electric discharge current is passed through these two electric discharge wires 52 and 51 is sought in advance. Ultimately, a prescribed margin is added to the absolute value of the electrified potential. That is, the second threshold value is calculated and determined as described below.

Hence, when the absolute value of the electrified potential is less than the second threshold value, the default value of the electric discharge current to be passed through the electric discharge wire of the electric charging unit 4 is maintained accordingly. By contrast, when the absolute value of the electrified potential is greater than the second threshold value, the charging performance of the electric charging unit 4 may be likely insufficient.

Accordingly, the electric discharge current more than the default value is passed through the electric discharge wires 52 and 51 of the electric charging unit 4. However, when the electric discharge current is increased in this way, an emission amount of ozone also increases, and accordingly the life of the ozone filter is shortened. Further, electric discharge products other than the ozone also increase and can be a factor to shorten the life of the electric charging unit 4 as well. Again, however, by increasing the electric discharge current in a limited extend as described above, these adverse effects can be likely reduced to the minimum necessary.

Here, an electrified amount of the developer stored in the developing device 5 (i.e., either developer when two-component developer is employed or toner when one-component development is employed) and a sensitivity of the rotary photoconductor vary in accordance with a change in the environment. However, there is a correlation between sensitivity of a rotary photoconductor and temperature. That is, in general, when the temperature is high, the sensitivity of the rotary photoconductor increases. By contrast, when the temperature is low, the sensitivity of the rotary photoconductor decreases. Also, there is a correlation between an electrified amount of developer and absolute humidity as well. That is, in general, when the humidity is high, the electrified amount of the developer decreases. By contrast, when the humidity is low, the electrified amount of the developer increases.

As described earlier, the developing potential capable of obtaining the target adhering amount of toner is calculated, and image formation conditions (e.g., an LD power, a charging bias, and a developing bias) are adjusted to obtain the developing potential based on a calculation result. Hence, when the electrified amount of developer decreases due to high humidity, an inclination of a linear line that represents a toner adhering amount in relation to the developing potential as shown in FIG. 4 grows, and accordingly the developing potential to obtain a desired image density (i.e., a desired adhering amount of toner) decreases. When the developing potential is relatively small, the electric charging bias needs to be decreased to lower the electrified potential of the surface of the rotary photoconductor as typically shown in FIGS. 11A to 11C. By contrast, when the electrified amount of the developer increases due to low humidity, the inclination of the linear line that represents a toner adhering amount in relation to a developing potential as shown in FIG. 4 decreases, and accordingly, the developing potential capable of obtaining the desired image density (i.e., the desired toner adhering amount) increases. When the developing potential is relatively great, the electric charging bias needs to increase to enhance the electrified potential of the surface of the rotary photoconductor as typically shown in FIGS. 12A to 12C.

Figure 13A:
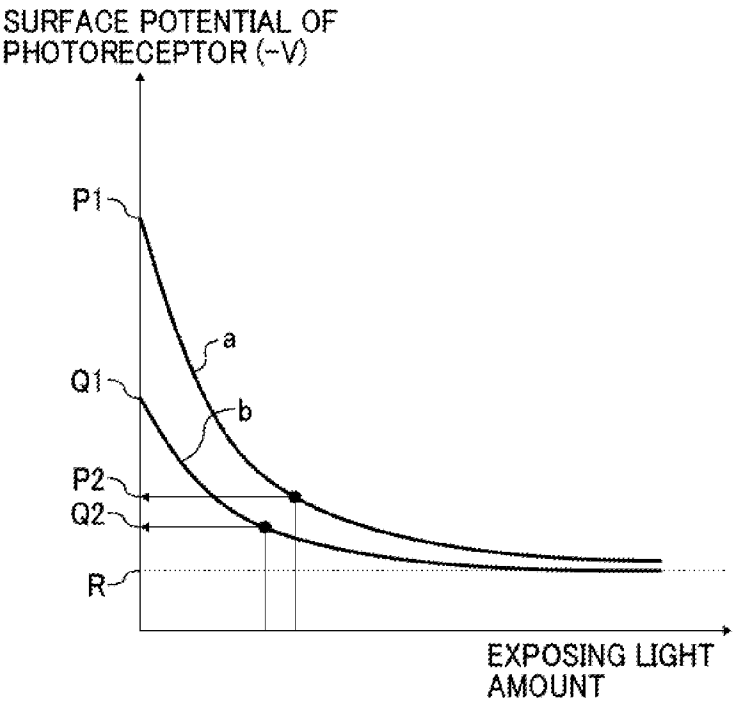
FIGS. 13A and 13B are charts collectively illustrating an exemplary relation between a quantity of exposing light and a surface potential of the rotary photoconductor as a comparative example.
Figure 13B:
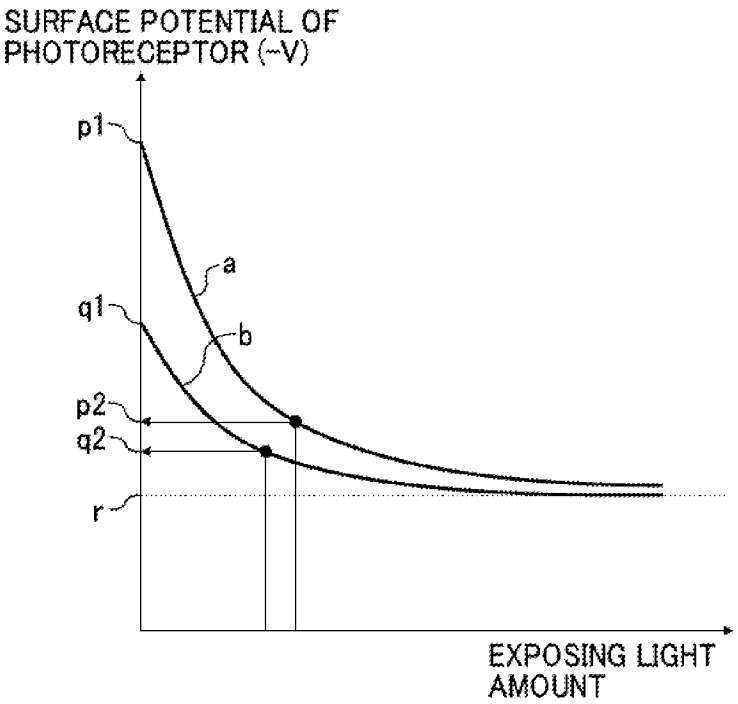

Now, a change in a relation between a surface potential of the rotary photoconductor and an amount of exposing light occurring when an electrified amount of developer and a sensitivity of the rotary photoconductor change due to a change in the environment is described with reference to FIGS. 13A and 13B. That is, FIGS. 13A and 13B collectively illustrate an exemplary relation between a quantity of exposing light and a surface potential of the rotary photoconductor. In each of the drawings, a horizontal axis indicates the quantity of exposing light while a vertical axis indicates the surface potential of the rotary photoconductor. FIG. 13A indicates the relation between a quantity of exposing light and a surface potential of the rotary photoconductor when a sensitivity of the rotary photoconductor is high, while FIG. 13B indicates a relation therebetween when a sensitivity of the rotary photoconductor is low. In accordance with a level (i.e., high or low) of the electrified potential of the surface of the rotary photoconductor, a quantity of exposing light needed to keep a prescribed halftone density and a line width varies. In this respect, in FIGS. 13A and 13B, a typical relation between the quantity of exposing light and the surface potential of the rotary photoconductor obtained when the electrified potential of the surface of the rotary photoconductor is relatively high is illustrated by a solid line. Meanwhile, a typical relation between the quantity of exposing light and the surface potential of the rotary photoconductor obtained when the electrified potential of the surface of the rotary photoconductor is relatively low is illustrated by a solid line b as well. On the solid line a of FIG. 13A, a point P1 indicates an electrified potential of the surface of the rotary photoconductor, while a point P2 indicates a potential of an exposed surface portion of the rotary photoconductor. On the solid line b of FIG. 13B, a point Q1 indicates an electrified potential of the surface of the rotary photoconductor, while a point Q2 indicates a potential of an exposed surface portion of the rotary photoconductor. As shown in FIG. 13A, as the quantity of exposing light increases, the surface potential of the rotary photoconductor converges on a potential shown by a point R. Similarly, on the solid line a of FIG. 13B, a point p1 indicates an electrified potential of the surface of the rotary photoconductor, while a point p2 indicates a potential of an exposed surface portion of the rotary photoconductor. On the solid line b of FIG. 13B, a point q1 indicates an electrified potential of the surface of the rotary photoconductor, while a point q2 indicates a potential of an exposed surface portion of the rotary photoconductor. As shown in FIG. 13B, as the quantity of exposing light increases, the surface potential of the rotary photoconductor converges on a potential shown by a point r.

As shown in FIG. 13A, an absolute value of the potential generated at the point P1 is greater than that of the potential generated at the point Q1. Also in the drawing, an absolute value of the potential generated at the point P2 is greater than that of the potential generated at a point Q2 as well. Further, in FIG. 13B, an absolute value of the potential generated at the point p1 is greater than that of the potential generated at a point q1 as well. An absolute value of the potential generated at a point p2 is greater than that of the potential generated at a point q2. In addition, absolute values of the potentials generated at the points p2 and q2 are greater than the absolute values of the potentials generated at the points P2 and Q2 as shown in FIG. 13B. An absolute value of the potential generated at a point r shown in FIG. 13A is greater than that of the potential generated at a point R as shown in FIG. 13B as well.

Under the high temperature and low humidity environment, since an electrified amount of developer is relatively great while a sensitivity of the rotary photoconductor is relatively high, the relation between the amount of exposing light and the surface potential of the rotary photoconductor is established as shown by a solid line a in FIG. 13A. By contrast, under the low temperature and low humidity environment, since the electrified amount of developer is relatively great while the sensitivity of the rotary photoconductor is relatively low, the relation between the amount of exposing light and the surface potential of the rotary photoconductor is established as shown by a solid line a in FIG. 13B. Also, under the low temperature and high humidity environment, since the electrified amount of developer is relatively small while the sensitivity of the rotary photoconductor is relatively low as well, the relation between the amount of exposing light and the surface potential of the rotary photoconductor is established as shown by a solid line b in FIG. 13B. Hence, under the combination of the high temperature and high humidity environment, the potential of the exposed surface portion of the rotary photoconductor is located closest to the positive side among the above-described four combinations (i.e., high temperature and low humidity, high temperature and high humidity, low temperature and low humidity, and low temperature and high humidity).

As described above, when the potential of the exposed surface portion of the rotary photoconductor is closer to the positive side, the phenomenon, in which a polarity of the surface potential of the rotary photoconductor as an electrostatic latent image bearer is reversed after completion of a transfer process, easily occurs. Accordingly, since the above-described phenomenon, in which a polarity of the surface potential of the rotary photoconductor as an electrostatic latent image bearer is reversed after completion of a transfer process, easily and most likely occurs under the high temperature and high humidity environment, the pre-electric charge removal electric charging process is executed. In this way, it may be determined whether or not the pre-electric charge removal electric charging process is executed depending on temperature and humidity of the environment in which the printer is installed.

Although in the above-described embodiment, the rotary photoconductor is electrified in a negative polarity, the present invention can be applied to a rotary photoconductor charged in a positive polarity. In such a situation, the above-described embodiment is modified by replacing either the positive polarity with the negative polarity or the negative polarity with the positive polarity, appropriately.

Now, a second embodiment of the present invention, in which the present invention is applied to a color printer that employs an electrophotographic system as an image forming apparatus (hereinafter simply referred to as a printer 100), is described with reference to applicable drawings. An overall configuration of the printer of the second embodiment is substantially the same as that of the printer of the first embodiment as shown in FIG. 1. However, a difference between the first and second embodiments in view of a configuration is that although the toner image forming unit 6 described in the first embodiment with reference to FIG. 2 includes the second erase lamp 30, the toner image forming unit 6 of the second embodiment does not include the second erase lamp 30, by contrast. A configuration of the electric charging unit 4 in the second embodiment is substantially the same as that of the electric charging unit 4 as described with reference to FIGS. 5 and 6.

New, an electric charge removing process (i.e., a diselectrifying process) implemented according to the second embodiment is herein below described in greater detail. That is, when the process control is executed, the control unit 150 compares an absolute potential generated in an exposed portion on the surface of the rotary photoconductor 1 detected by the first surface potential sensor 37 with a prescribed first threshold value. The first threshold value is determined and obtained in the below described manner.

Initially, a relation between a potential of an exposed surface portion of the rotary photoconductor 1 existing before executing a transfer process and that existing after completion of the transfer process is previously investigated. Based on the relation, an absolute value of the potential existing before executing the transfer process that causes the potential existing after completion of the transfer process to have a positive polarity across the 0 volts is sought. Subsequently, the first threshold value is determined by adding a prescribed margin to the absolute value of the potential existing before executing the transfer process.

When the absolute value of the potential of the exposed surface portion of the rotary photoconductor 1 is smaller than the first threshold value, a potential existing on the exposed surface portion of the rotary photoconductor 1 is highly likely reversed to a positive polarity after completion of the transfer process. In this situation, the control unit 150 determines that the afterimage easily occurs and controls to initiate the pre-electric charge removal electric charging process as described below. That is, the first electric discharge wire 53 acts as a charger that executes the pre-electric charge removal electric charging process and applies an electric charge having a negative polarity to a portion in which a surface potential of the rotary photoconductor 1 has a positive polarity. After changing the potential of the surface portion of the rotary photoconductor 1 having the positive polarity to the negative polarity, the first erase lamp 31 is operated to emit electric charge removing light. Here, when the first electric discharge wire 53 applies the electric charge of the negative polarity to the surface of the rotary photoconductor 1, the first erase lamp 31 may irradiate the electric charge removing light at the same time as well.

By contrast, when the absolute value of the potential of the exposed surface portion of the rotary photoconductor 1 is greater than the first threshold value, the first erase lamp 31 may be controlled to irradiate the surface of the rotary photoconductor 1 with the electric charge removing light without executing the pre-electric charge removal electric charging process.

When the first erase lamp 31 is used at the same time when the pre-electric charge removal electric charging process is executed, the remaining two electric discharge wires (i.e., the second and third electric discharge wires 52 and 51) necessarily charge the rotary photoconductor 1 with electricity in the next image formation process. For this reason, depending on a desired electrified voltage, the electric charging unit 4 may lack a charging performance to realize the desired electrified voltage. Subsequently, when the above-described process control is implemented, the control unit 150 compares an absolute value of an electrified potential detected by the first surface potential sensor 37 with the below described second threshold value. That is, the above-described second threshold value is calculated and determined in the below described manner. Specifically, an absolute value of an electrified potential which exceeds a charging performance of the electric charging unit 4 when a default value of electric discharge current passed through two electric discharge wires is initially sought in advance. Subsequently, a prescribed margin is added to the absolute value of the electrified potential thereby determining the second threshold value.

When the absolute value of the electrified potential is less than the second threshold value, a default value of the electric discharge current to be passed through the electric discharge wire of the electric charging unit 4 is maintained. By contrast, when the absolute value of the electrified potential is greater than the second threshold value, since the charging performance of the electric charging unit 4 may be likely insufficient, an electric discharge current more than the default value is passed through the electric discharge wire of the electric charging unit 4. When the electric discharge current is increased in this way, an emission amount of ozone is also increased and accordingly, the life of an ozone filter is shortened. Also, electric discharge products other than the ozone increases at the same time and can be a factor to also shorten the life of the electric charging units 4 as well. However, by increasing the electric discharge current in a limited extend as described above, these adverse effects can be reduced to the minimum necessary.

Further, it may be determined whether or not the pre-electric charge removal electric charging process is executed depending on temperature and humidity of the environment in which the printer installed. For example, since a polarity of the surface potential of the electrostatic latent image bearer is likely reversed after completion of the transfer process and the afterimage most likely occurs under high temperature and high humidity environment, pre-electric charge removal electric charging process may be performed in such a situation.

Although in the above-described embodiment, the rotary photoconductor is electrified in the negative polarity, the present invention can be applied to a rotary photoconductor charged in the positive polarity. In such a situation, the above-described embodiment is modified by replacing either the positive polarity with the negative polarity or the negative polarity with the positive polarity, appropriately.

Figure 19:
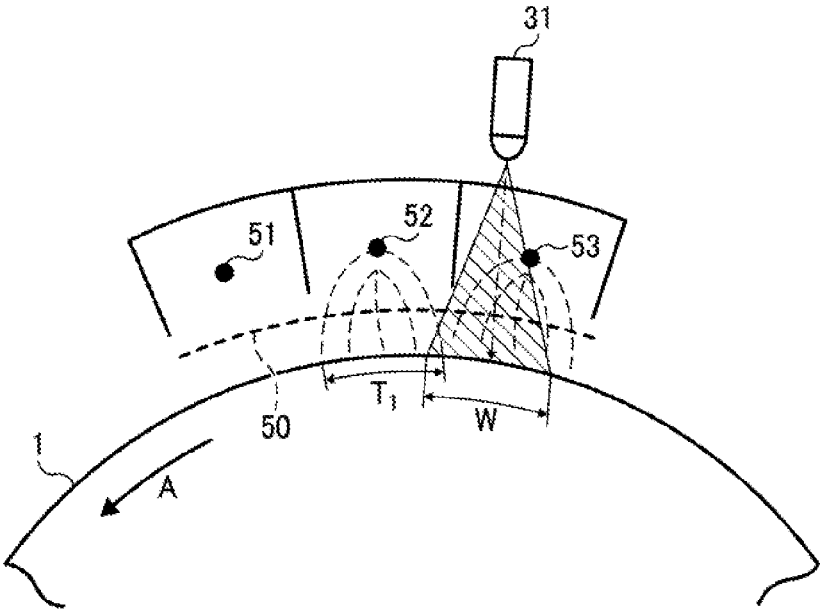
FIG. 19 is a diagram illustrating an exemplary situation, in which an irradiation region W into which the first erase lamp emits electric charge removing light, partially overlaps with an electric discharge region electrified by a second electric discharge wire as a comparative example.

Further, in the above-described first and second embodiments, an irradiation region W of the electric charge removing light emitted from the first erase lamp 31 sometimes partially overlaps with an electric discharge region T1 electrified by the second electric discharge wire 52 as shown in FIG. 19. Here, the electric discharge region T1 of the second electric discharge wire 52 is a region of the surface of the rotary photoconductor onto which an electric charge having a positive polarity pours. That is, the electric discharge region T1 is a so-called electrified region on the surface of the rotary photoconductor to be charged with electricity. Accordingly, in such a situation, at a moment when the surface of the rotary photoconductor is electrified by the second electric discharge wire 52 with electricity in the negative polarity, the electric discharge region Ti overlapping with the irradiation region W is diselectrified by the electric charge removing light. As a result, charging performance of the electric charging unit 4 likely decreases conventionally. For this reason, the electric discharge region T1 electrified by the second electric discharge wire 52 is desirably not irradiated by the electric charge removing light emitted from the first erase lamp 31. In this regard, first to fourth exemplary configurations are herein below described, in which the electric discharge region T1 of the second electric discharge wire 52 is not irradiated by the first erase lamp 31 with the electric charge removing light.

Figure 20:
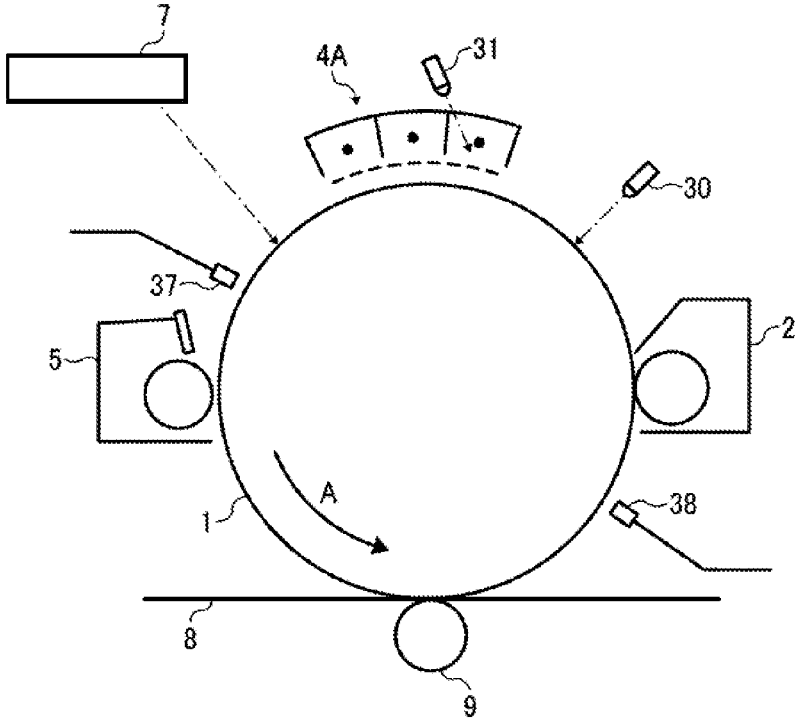
FIG. 20 is a diagram schematically illustrating an exemplary configuration of a printer with an electric charging unit according to a first modification of the present invention.
Figure 21:
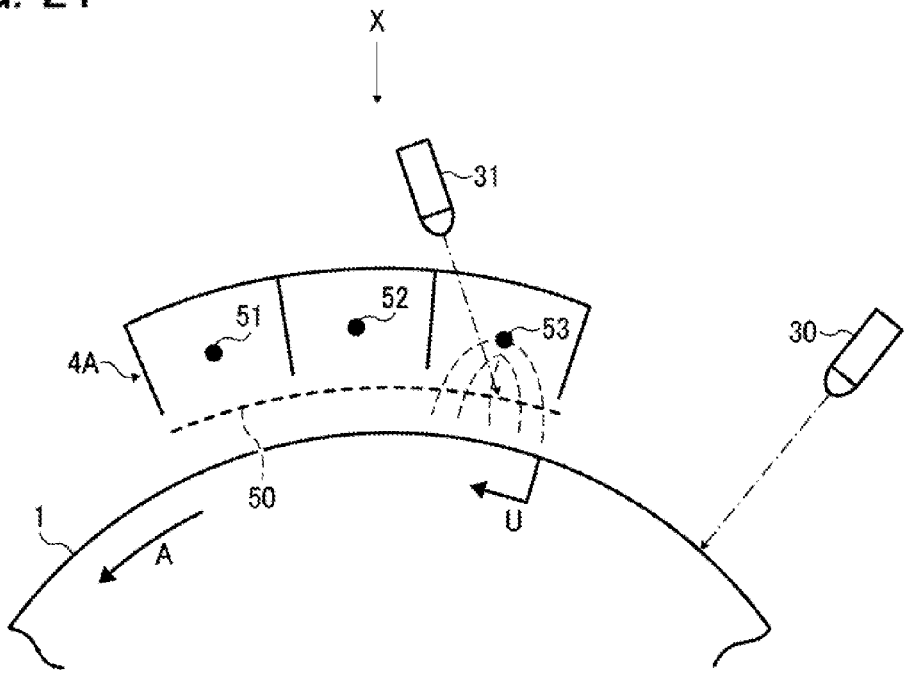
FIG. 21 is a diagram schematically illustrating an exemplary configuration of the electric charging unit included in the printer according to the first modification of the present invention.

Now, a first modification is described with reference to FIGS. 20 to 22. That is, FIG. 20 is a diagram schematically illustrating an exemplary configuration of a printer with an electric charging unit 4A according to the first modification of the above-described embodiment of the present invention. FIG. 21 is also a diagram schematically illustrating an exemplary configuration of the electric charging unit 4A employed in the first modification of the above-described embodiment of the present invention. As shown in FIGS. 20 and 21, in the electric charging unit 4A of the first modification, the first erase lamp 31 is disposed while tilting against a normal line of the rotary photoconductor so that an electric charge removing light irradiation surface of the first erase lamp 31 is located upstream in a surface moving direction of the rotary photoconductor. With such a configuration, the irradiation region W of the first erase lamp 31 does not overlap with the electric discharge region Ti of the second electric discharge wire 52 as shown in FIG. 21. With this, the surface of the rotary photoconductor electrified by the second electric discharge wire 52 can be prevented from being diselectrified by the electric charge removing light emitted from the first erase lamp 31, and accordingly, decreasing in charging performance of the electric charging unit 4 generally caused by the first erase lamp 31 can be prevented at the same time.

Figure 22:
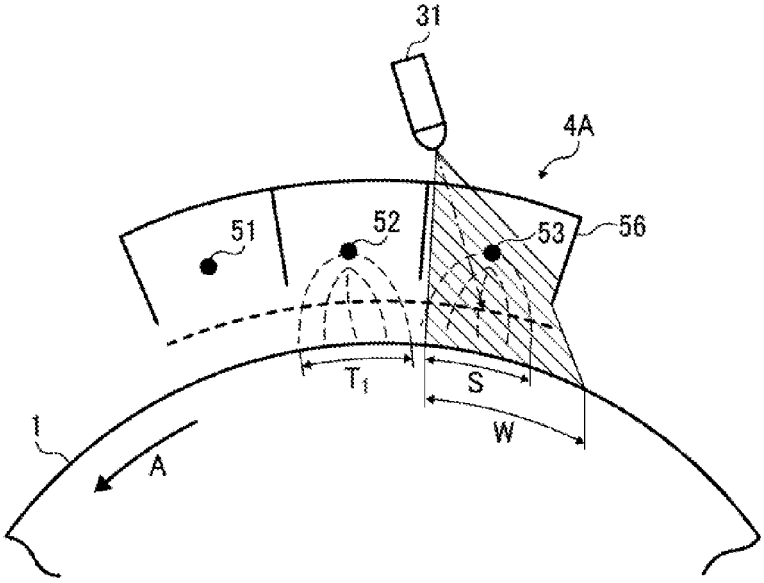
FIG. 22 is a diagram schematically illustrating an exemplary irradiation region, into which electric charge removing light is emitted from the first erase lamp, and an electric discharge region electrified by the second electric discharge wire as a comparative example according to the first modification of the present invention.

Also, as shown in FIG. 22, in the first modification, the electric charge removing light emitted from the first erase lamp 31 partially hits a sidewall of a first metal electric discharge shield 56. As a result, the electric charge removing light partially hitting the sidewall of the first metal electric discharge shield 56 is thereby reflected and likely enters the electric discharge region T1 of the second electric discharge wire 52. Therefore, a surface of the side wall is desirably roughened or similarly devised not to render reflecting light entering the electric discharge region T1 of the second electric discharge wire 52.

Figure 23:
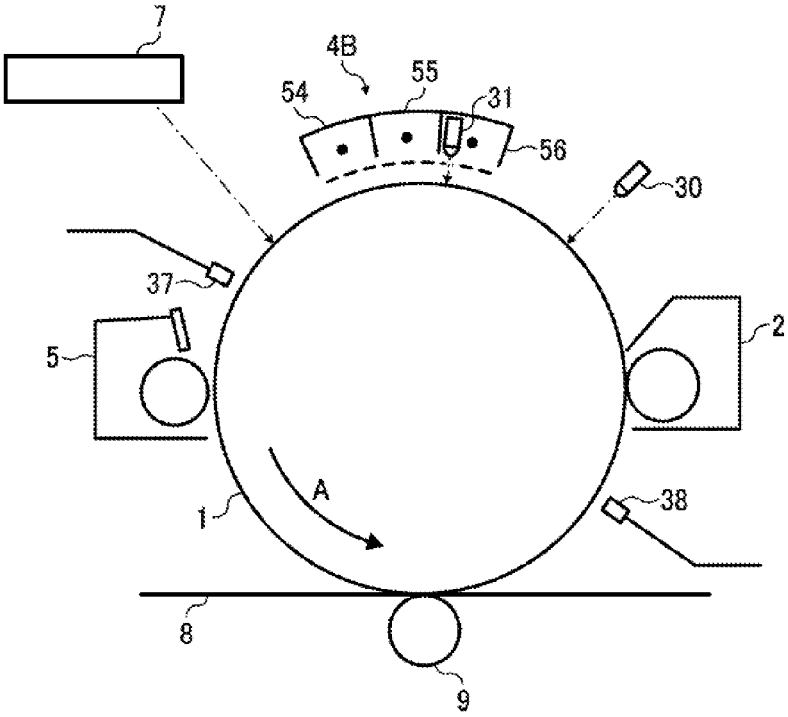
FIG. 23 is a diagram schematically illustrating an exemplary configuration of a printer including an electric charging unit according to a second modification of the present invention.
Figure 24:
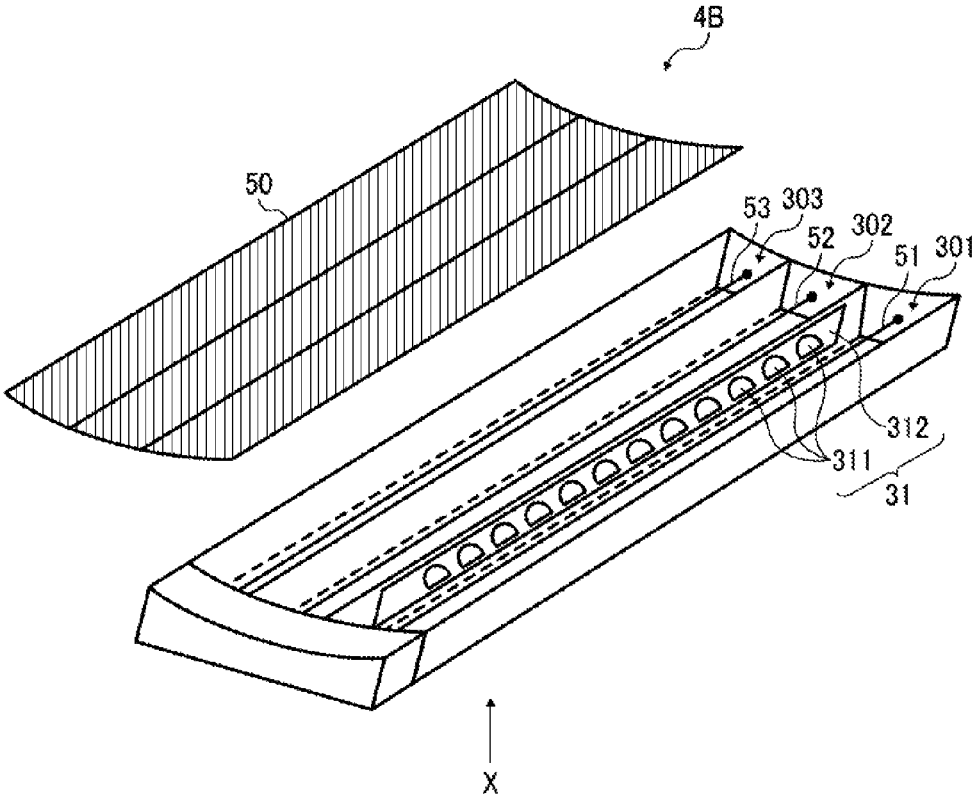
FIG. 24 is an exploded perspective view illustrating the electric charging unit of the second modification of the present invention.

Now, a second modification is described with reference to FIGS. 23 to 25. That is, FIG. 23 is a diagram schematically illustrating an exemplary configuration of a printer including an electric charging unit 4B of a second modification. FIG. 24 is an exploded perspective view illustrating the exemplary electric charging unit 4B of the second modification. As shown in FIG. 23, in the electric charging unit 4B of the second modification, the first erase lamp 31 is accommodated in the electric charging unit 4B. Specifically, the first erase lamp 31 is disposed in a first electric discharge shield 56 that shields the first electric discharge wire 53. As also shown in FIG. 24, the first erase lamp 31 includes multiple light-emitting elements 311, such as LEDs (Light Emitting Diodes), etc., aligning side by side on a base plate 312 in an axial direction of the rotary photoconductor 1. The base plate 312 of the first erase lamp 31 is attached to a partition wall 155 that partitions into the first and the second electric charging sections 301 and 302.

Figure 25:
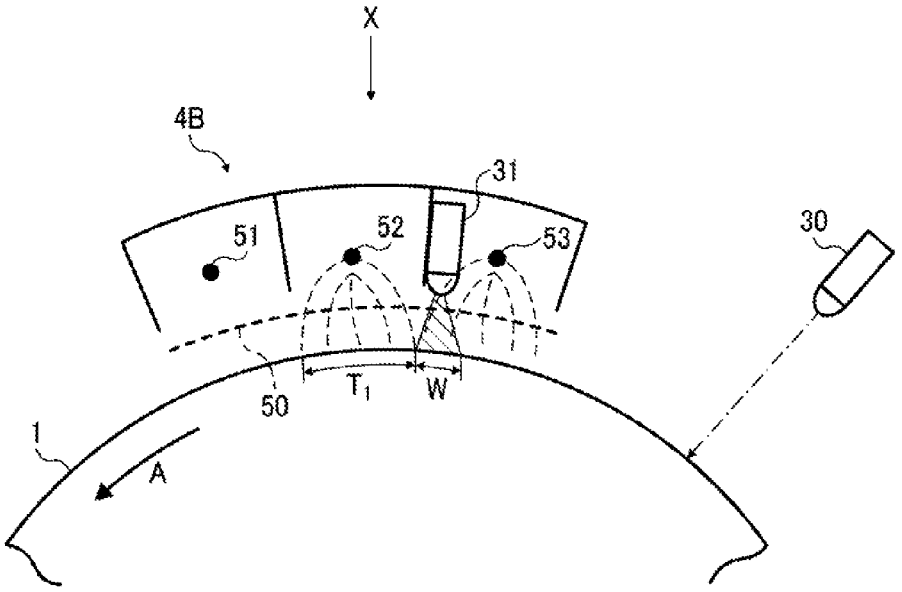
FIG. 25 is a diagram schematically illustrating an exemplary irradiation region, into which electric charge removing light is emitted from the first erase lamp, and an electric discharge region electrified by the second electric discharge wire as a comparative example according to the second modification of the present invention.

Thus, in the second modification, since the first erase lamp 31 is accommodated in the electric charging unit 4B as shown in FIG. 25, a distance between the surface of the rotary photoconductor and a light emitting surface of the first erase lamp 31 can be minimized more than when the first erase lamp 31 is disposed outside of the electric charging unit 4B as shown in FIG. 19. As a result, as understood by comparing FIG. 19 with FIG. 25, since the irradiation region W of the first erase lamp 31 can be narrowed, the irradiation region W of the first erase lamp 31 can be likely suppressed to overlap with the electric discharge region T1 of the second electric discharge wire 52. With this, the surface of the rotary photoconductor electrified by the second electric discharge wire 52 is rarely diselectrified by the electric charge removing light emitted from the first erase lamp 31, and accordingly, decreasing in charging performance of the electric charging unit 4 due to the first erase lamp 31 can be likely suppressed.

Further, in the second modification, since the first erase lamp 31 is accommodated in the electric charging unit 4B, the below described advantages can be also obtained as well. That is, the device can be more effectively miniaturized than when the first erase lamp 31 is disposed above the electric charging unit 4. Also, detachment and attachment of both of the first erase lamp 31 and the electric charging unit 4A (4B) can be easier as well. Further, since a connector to connect the first erase lamp 31 with a power source, not shown, and that to connect the electric charging unit 4B with a power source, not shown, can be integrated as a single unit connector, a configuration can be simplified at the same time as well.

Figure 26:
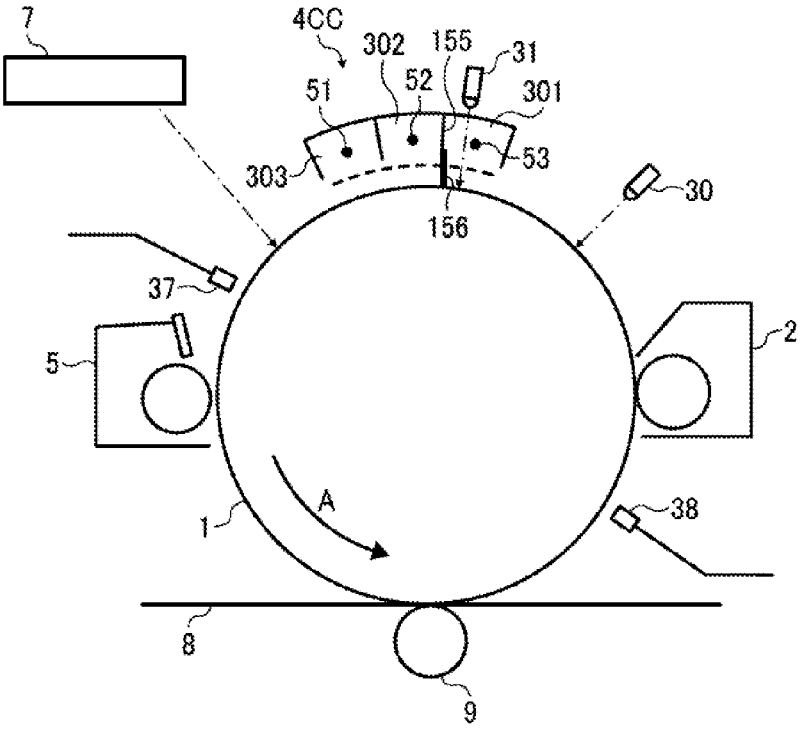
FIG. 26 is a diagram schematically illustrating an exemplary configuration of a printer including an electric charging unit according to a third modification of the present invention.

Now, a third modification is described with reference to FIGS. 26 to 31. FIG. 26 is a diagram schematically illustrating an exemplary configuration of a printer including an electric charging unit 4CC according to a third modification of the present invention. That is, as shown in FIG. 26, in an electric charging unit 4CC of the third modification, an independent light shield 156 as a light shield is provided in the partition wall 155 that partitions into the first and second electric charging sections 301 and 302. The independent light shield 156 is made of elastic material, such as polyurethane rubber, etc., and a tip thereof contacts a surface of the rotary photoconductor.

Figure 27:
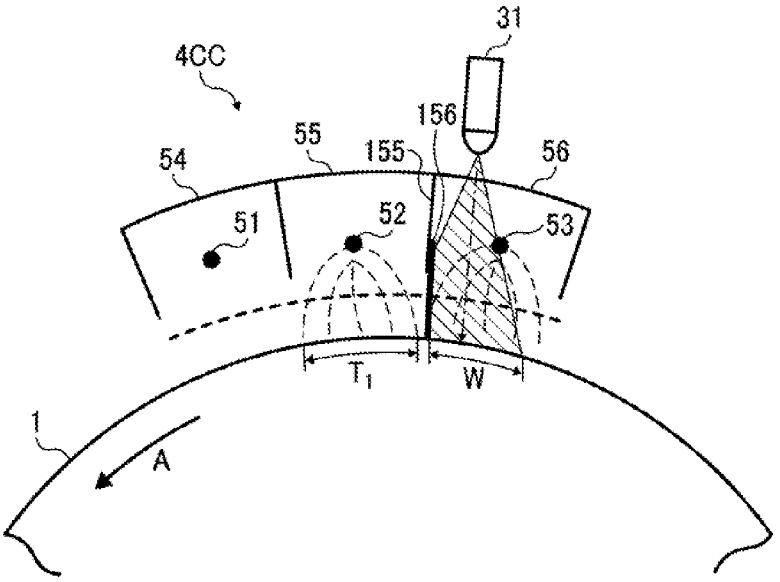
FIG. 27 is a diagram schematically illustrating an exemplary irradiation region, into which electric charge removing light is emitted from the first erase lamp, and an electric discharge region electrified by the second electric discharge wire according to the third modification of the present invention.

Accordingly, as shown in FIG. 27, since the independent light shield 156 is provided in the third modification 3, the electric charge removing light emitted from the first erase lamp 31 and directed to the electric discharge region T1 of the second electric discharge wire 52 can be blocked off by the independent light shield 156. That is, since the electric charge removing light emitted from the first erase lamp 31 dose not reach the electric discharge region T1 of the second electric discharge wire 52, the irradiation region W of the first erase lamp 31 does not overlap with the electric discharge region Ti of the second electric discharge wire 52. With this, the surface of the rotary photoconductor electrified by the second electric discharge wire 52 can be prevented from being diselectrified by the electric charge removing light of the first erase lamp 31. Accordingly, decreasing in charging performance of the electric charging unit 4 generally caused by the first erase lamp 31 can be prevented at the same time as well.

Further, although the independent light shield 156 is provided in the partition wall 155 to blocked off the electric charge removing light emitted from the first erase lamp 31 and directed to the electric discharge region T1 of the second electric discharge wire 52 in this third modification, the partition wall 155 itself can be extended near the surface of the rotary photoconductor to blocked off the electric charge removing light emitted from the first erase lamp 31 and directed to the electric discharge region T1 of the second electric discharge wire 52. In such a situation, an extended portion of the partition wall 155 acts as the light shield. Further, although the tip of the independent light shield 156 contacts the surface of the rotary photoconductor 1 in this modification, it can be separated from the surface of the rotary photoconductor 1 as well. That is, since the tip of the independent light shield 156 does not contact the surface of the rotary photoconductor 1, wear of the surface of the rotary photoconductor 1 due to the independent light shield 156 can be likely avoided thereby maintaining the prescribed life thereof. By contrast, when the shielding members 101 contacts the rotary photoconductor 1 as described earlier, the electric charge removing light emitted from the first erase lamp 31 and directed to the electric discharge region T1 of the second electric discharge wire 52 can be substantially completely blocked off Further, when the independent light shield 156 is made of elastic material, the independent light shield 156 can be inhibited to increase contact pressure against the rotary photoconductor 1 even when an attaching positioning thereof is slightly deviated toward the rotary photoconductor 1. That is, the independent light shield 156 elastically deforms at the time. Hence, wear of the rotary photoconductor can be likely prevented.

Figure 28:
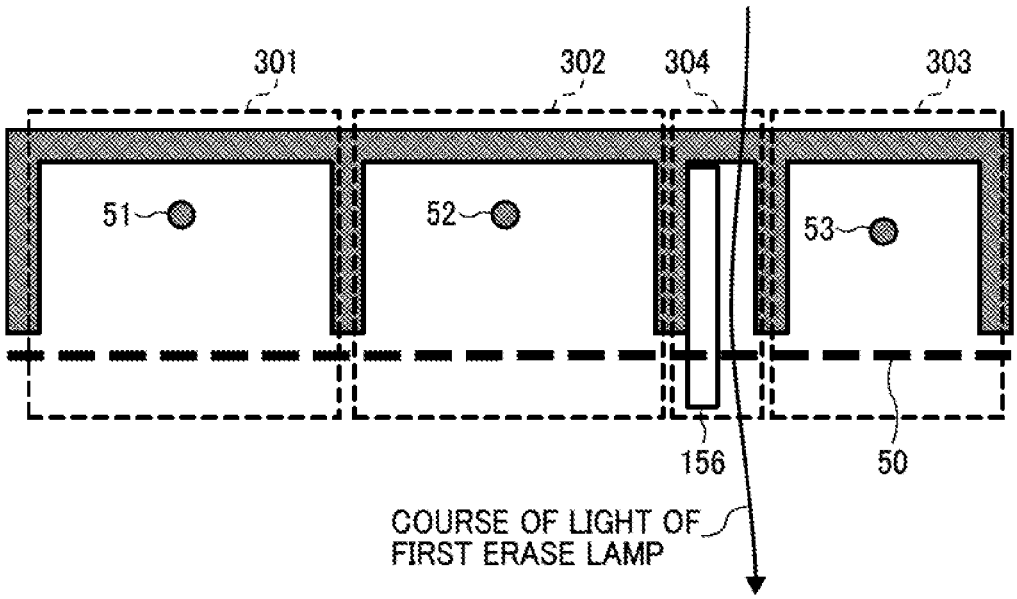
FIG. 28 is a cross-sectional view schematically illustrating a modification of the electric charging unit employed in the third modification of the present invention.
Figure 29:
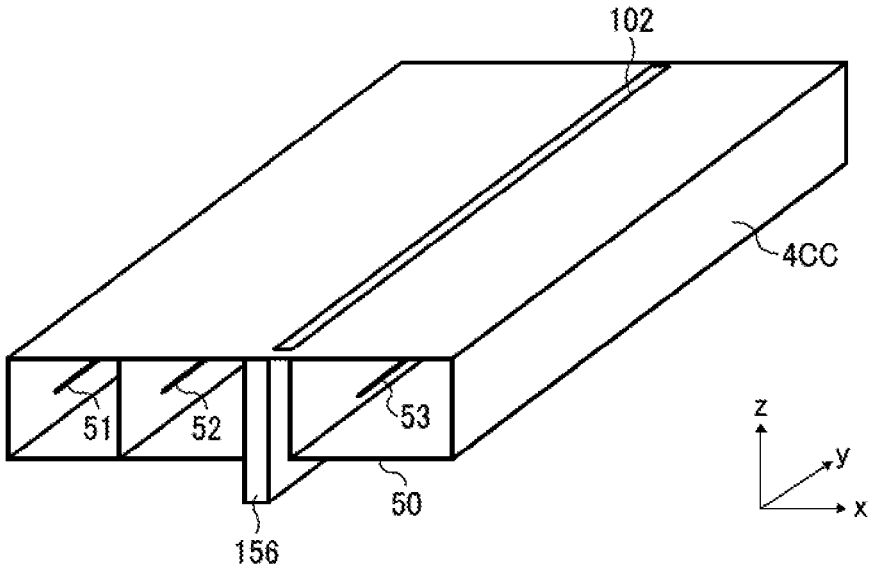
FIG. 29 is a perspective view schematically illustrating the modification of the electric charging unit employed in the third modification as shown in FIG. 28.
Figure 30:
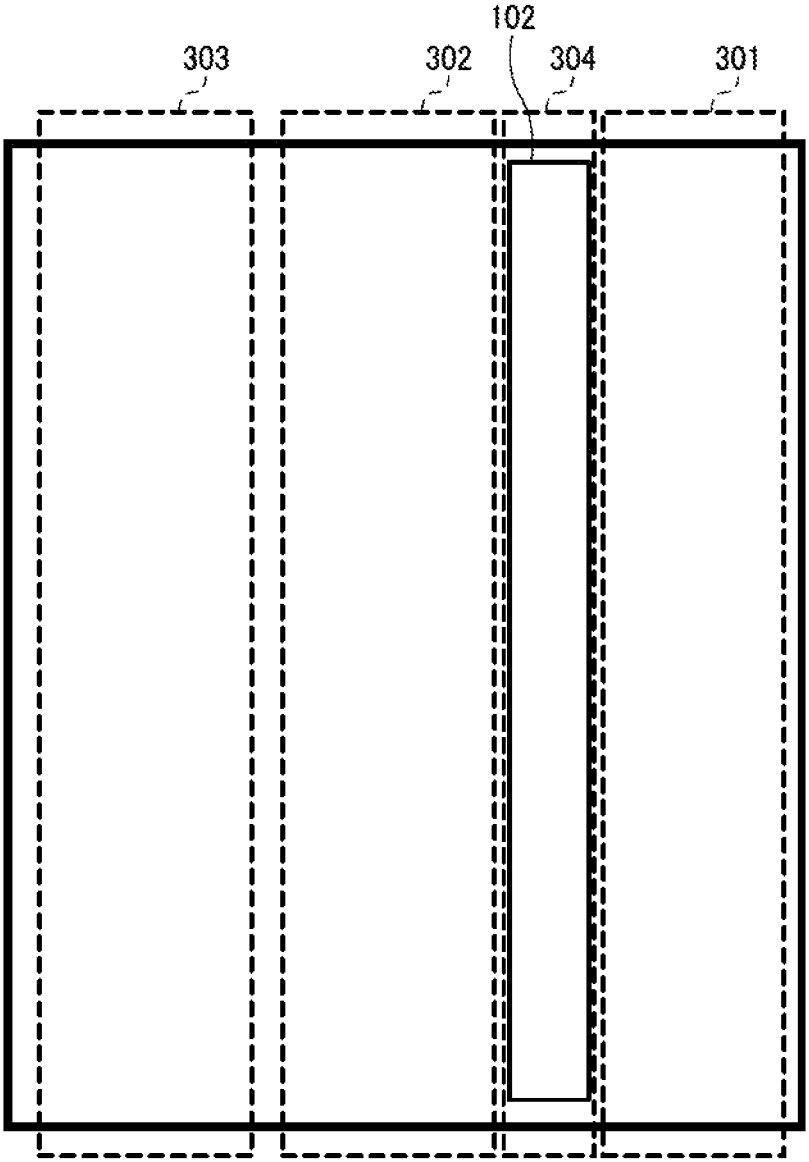
FIG. 30 is a plan view illustrating the modification of the electric charging unit employed in the third modification as shown in FIG. 28, which is taken from above the modification of the electric charging unit.
Figure 31:
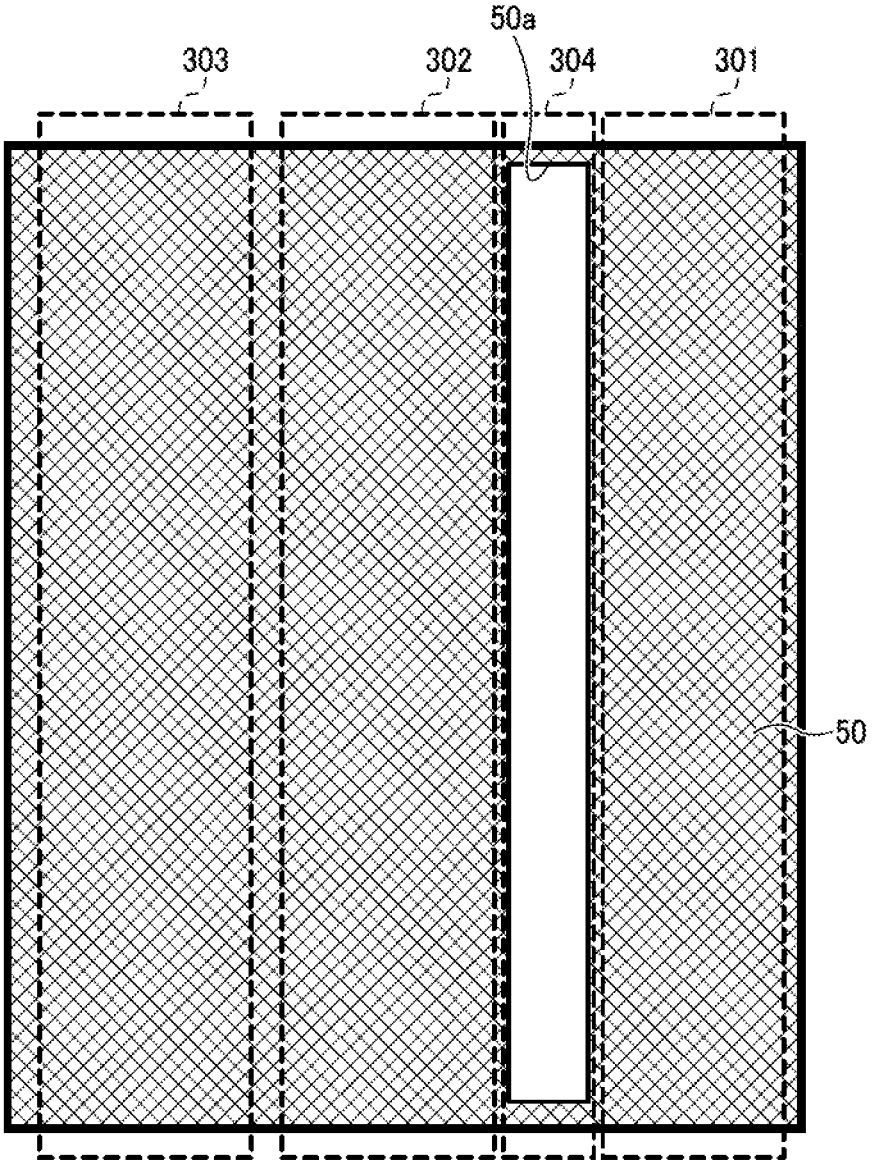
FIG. 31 is a bottom view illustrating the modification of the electric charging unit employed in the third modification as shown in FIG. 28, which is taken from below the modification of the electric charging unit.

Further, as shown in FIGS. 28 and 29, an electric charge removing light channel section 304 acting as an electric charge removing light path of the first erase lamp 31 may be provided between the first and second electric charging sections 301 and 302, while providing the independent light shield 156 on a partition wall that separates the second electric charging section 302 from the electric charge removing light channel section 304. In such a situation, in an upper plane of the electric charge removing light channel section 304 in the housing of the electric charging unit 4, an opening 102 is formed to allow the electric charge removing light emitted from the first erase lamp 31 to pass therethrough as shown in FIGS. 29 and 30. Further, as shown in FIG. 31, since the electric charge removing light channel section 304 does not need a grid, a grid opening 50*a* is formed at a position of the grid 50 corresponding to the electric charge removing light channel section 304. Thus, the electric charge removing light emitted from the first erase lamp 31 is efficiency irradiated onto the surface of the rotary photoconductor 1 without being impeded by the grid. With such a configuration, by providing the independent light shield 156, the electric charge removing light emitted from the first erase lamp 31 and directed toward the electric discharge region T1 of the second electric discharge wire 52 can be blocked off With this, decreasing in charging performance of the electric charging unit 4 generally caused by the first erase lamp 31 can be minimized.

Figure 32:
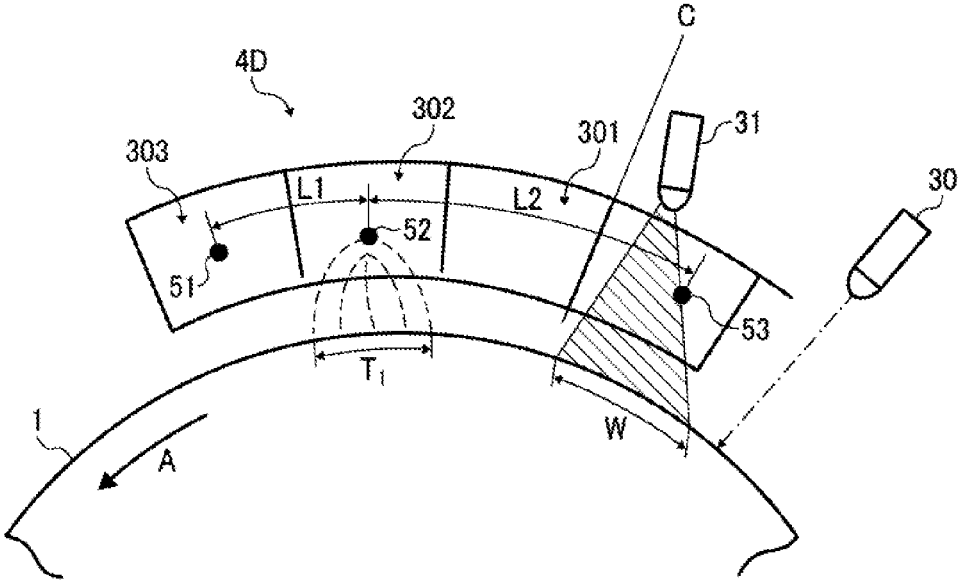
FIG. 32 is a diagram schematically illustrating an exemplary configuration of the electric charging unit according to a fourth embodiment of the present invention.

Now, a fourth modification is described with reference to FIGS. 32 and 33. That is, FIG. 32 is a diagram schematically illustrating an exemplary configuration of the electric charging unit 4D according to a fourth modification of the present invention. In the electric charging unit 4D of the fourth modification, an interval L2 between the first and second electric discharge wires 53 and 52 is elongated than that of L1 between the second and third electric discharge wires 52 and 51. Hence, the first erase lamp 31 can be disposed further away from the second electric charging section 302 when compared with a system in which the interval between the first and second electric discharge wires 53 and 52 is the same as the distance between the second and third electric discharge wires 52 and 51. Further, in this fourth modification, the first erase lamp 31 is disposed upstream of a central part C of the first electric charging section 301 in a surface moving direction of the rotary photoconductor 1. With this, the first erase lamp 31 can be disposed such that the irradiation region W thereof does not overlap with the electric discharge region T1 of the second electric discharge wire 52. Hence, the surface of the rotary photoconductor 1 charged by the second electric discharge wire 52 can prevent from being diselectrified by the electric charge removing light emitted from the first erase lamp 31, and accordingly decreasing in charging performance of the electric charging unit 4 due to the electric charge removing light emitted from the first erase lamp 31 can be minimized or prevented.

The above-described first to fourth modifications may be optionally combined as well. That is, by optionally combining the above-described more than one of the first to fourth modifications, the surface of the rotary photoconductor charged by the second electric discharge wire 52 can more effectively prevent from being diselectrified by the electric charge removing light elimination of the first erase lamp 31. With this, decreasing in charging performance of the electric charging unit 4 due to the electric charge removing light emitted from the first erase lamp 31 can be more effectively minimized or prevented.

Figure 33:
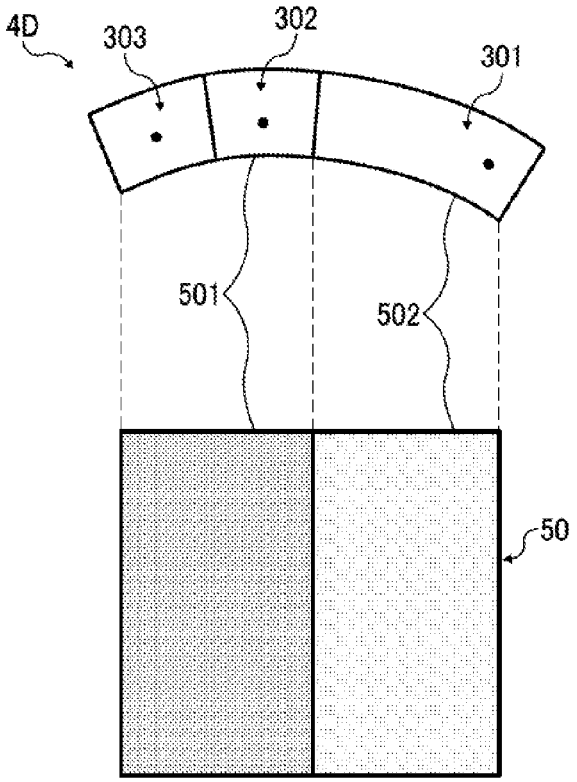
FIG. 33 is a cross-sectional view schematically illustrating an exemplary configuration of the electric charging unit and a plan view schematically illustrating an exemplary grid portion provided in a first electric charging unit formed coarser than that provided in the second and third electric charging devices according to one embodiment of the present invention.

Further, as shown in FIG. 33, a first grid portion 502 of the grid 50 provided in the first electric charging section 301 is desirably coarser than a second grid portion 501 of the grid 50 provided over the second and third electric charging sections 302 and 303. Hence, the electric charge removing light emitted from the first erase lamp 31 is rarely blocked off by the first grid portion 502, and accordingly, a quantity of electric charge removing light arriving at the rotary photoconductor 1 can be increased. With this, the first erase lamp 31 can enhance electric charge removing performance Further, when the first grid portion 502 is not employed in the first electric charging section 301, a quantity of electric charge removing light arriving at the rotary photoconductor 1 can be also increased, and the first erase lamp 31 can enhance electric charge removing performance as well. With this, the surface of the rotary photoconductor 1 can be absolutely diselectrified to have the potential of 0 volts, and accordingly occurrence of the afterimage can be preferably suppressed.

Furthermore, the surface of the rotary photoconductor can be preferably diselectrified with a small quantity of electric charge removing light, and accordingly the voltage to be applied to the first erase lamp 31 can be reduced at the same time. As a result, power can be saved in the image forming apparatus.

According to one aspect of the present invention, even when a polarity reversing phenomenon occurs after completion of a transfer process such that a polarity of an exposed surface portion of the electrostatic latent image bearer is reversed to be opposite to an electrified polarity after completion of the transfer process, a surface potential of the electrostatic latent image bearer can be leveled off, thereby capable of preventing or suppressing occurrence of an afterimage, because the electric charge removing device irradiates the surface of the electrostatic latent image bearer with electric charge removing light after the pre-electric charge removal electric charging process is applied to the surface of the electrostatic latent image bearer. Further, since an electric discharge wire which uniformly electrifies the electrostatic latent image bearer and that which executes the pre-electric charge removal electric charging process are integrally accommodated in a housing, a separately employed electric charging unit is not needed other than that which uniformly electrifies the electrostatic latent image bearer to form an image. That is, according to one aspect of the present invention, an image forming apparatus includes a rotary electrostatic latent image bearer to bear an electrostatic latent image, a first electric charging unit having at least one first electric discharge wire to uniformly electrify a surface of the electrostatic latent image bearer, and an electrostatic latent image writing device to write an electrostatic latent image on the surface of the electrostatic latent image bearer electrified by the first electric charging unit. The image forming apparatus further includes a developing device to render the electrostatic latent image borne on the electrostatic latent image bearer visible as a toner image with toner, a transfer device to transfer the toner image obtained by developing the electrostatic latent image onto a transfer medium in a transfer process, and a second electric charging unit having a second electric discharge wire to execute a pre-electric charge removal electric charging process by electrifying the surface of the electrostatic latent image bearer after completion of the transfer process executed by the transfer device. Further included in the image forming apparatus is a first electric charge removing device to diselectrify the surface of the electrostatic latent image bearer by irradiating the surface of the electrostatic latent image bearer with first electric charge removing light subsequent to the pre-electric charge removal electric charging process. The at least one first electric discharge wire provided in the first electric charging unit and the second electric discharge wire provided in the second electric charging unit are accommodated in a single housing. The second electric discharge wire provided in the second electric charging unit is disposed upstream of the at least one first electric discharge wire in a rotational direction of the electrostatic latent image bearer. The first electric charge removing device is disposed within a discharge region of the second electric discharge wire. The first electric charge removing device irradiates the surface of the electrostatic latent image bearer with the electric charge removing light on a downstream side of an extreme upstream edge of the discharge region of the second electric discharge wire in the rotational direction of the electrostatic latent image bearer.

According to another aspect of the present invention, since the pre-electric charge removal electric charging process is not required when a polarity of an exposed surface portion of the electrostatic latent image bearer is the same as an electrified polarity even after a transfer process is completed, only the second erase lamp 30 is operated to emit electric charge removing light while prohibiting the first erase lamp 31 that executes the pre-electric charge removal electric charging process from operating. Accordingly, irradiation of the erase lamp that generally shortens the life of the electrostatic latent image bearer 1 due to light fatigue can be minimized to a prescribed level capable thereby capable of preventing the afterimage. With this, the rotary photoconductor 1 can effectively maintain a prescribed span of life. That is, according to another aspect of the present invention, the image forming apparatus further includes a second electric charge removing device opposed to the electrostatic latent image bearer between the transfer device and the first electric charging unit to irradiate the surface of the electrostatic latent image bearer with electric charge removing light. The image forming apparatus also includes a control unit to control operation of a second irradiation process of irradiating the surface of the electrostatic latent image bearer with the second electric charge removing light from the second electric charge removing device and a series of the second irradiation process, the pre-electric charge removal electric charging process, and a first irradiation process of irradiating the surface of the electrostatic latent image bearer with the first electric charge removing light from the first electric charge removing device. The control unit initiates one of the second irradiation process as a single diselectrifying process and the series of the second irradiation process, the pre-electric charge removal electric charging process, and the first irradiation process executed in this order as a complex diselectrifying process.

According to yet another aspect of the present invention, since a first threshold value is established based on a prescribed absolute value of a potential existing before a transfer process which changes to a positive polarity across 0 volts when the transfer process is completed and a prescribed margin added thereto as well, necessity of the pre-electric charge removal electric charging process can be recognized when an absolute potential of an exposed surface portion of the electrostatic latent image bearer is less than the first threshold value after an electrostatic latent image is written onto the surface of the electrostatic latent image bearer. Accordingly, when the control unit carries out the above-described processes including the pre-electric charge removal electric charging process, the afterimage phenomenon can be effectively reduced. That is, according to yet another aspect of the present invention, the control unit initiates the series of the second irradiation process, the pre-electric charge removal electric charging process, and the first irradiation process when an absolute value of a potential existing after completion of the transfer process in a surface portion of the electrostatic latent image bearer in which the electrostatic latent image is written is less than a prescribed first threshold value.

According to yet another aspect of the present invention, since a first threshold value is established based on a prescribed absolute value of a potential existing before a transfer process which changes to a positive polarity across 0 volts when the transfer process is completed and a prescribed margin added thereto as well, it can be recognized that the surface of the electrostatic latent image bearer can be diselectrified without applying the pre-electric charge removal electric charging process to the surface of the electrostatic latent image bearer when an absolute potential of an exposed surface portion of the electrostatic latent image bearer is greater than the first threshold value after an electrostatic latent image is written onto the surface of the electrostatic latent image bearer. Accordingly, since irradiation used in executing the pre-electric charge removal electric charging process is not needed in the above-described situation, the control unit accordingly prohibits the first erase lamp 31 from operating to effectively avoid shortening of the life of the rotary photoconductor. That is, according to yet another aspect of the present invention, in the above-described image forming apparatus, the control unit initiates the second irradiation process of irradiating the surface of the electrostatic latent image bearer with the second electric charge removing light from the second electric charge removing device while prohibiting the series of the second irradiation process, the pre-electric charge removal electric charging process, and the first irradiation process of irradiating the surface of the electrostatic latent image bearer with the first electric charge removing light from the first electric charge removing device when an absolute value of a potential existing after completion of the transfer process in a surface portion of the electrostatic latent image bearer with the written electrostatic latent image thereon is a prescribed first threshold value or more.

According to yet another aspect of the present invention, since a second threshold value is established based on an absolute value of a target electrified potential, which causes an electric charging unit to lack its electric charging performance when an electric charging process is executed by an electric discharge wire while flowing electric discharge current having a default value through the electric discharge wire, and a prescribed margin added thereto as well, the control unit can increase the electric discharge current to be passed through the electric discharge wire to be greater than the default value to be able to effectively avoid shortening of the life of the rotary photoconductor, when the pre-electric charge removal electric charging process is to be executed and the absolute value of the target electrified potential of the electrostatic latent image bearer is greater than the second threshold value. That is, according to yet another aspect of the present invention, in the above-described image forming apparatus, when the first electric charge removing device removes electric charge from the surface of the electrostatic latent image bearer and an absolute value of a target potential to be obtained by uniformly charging the surface of the electrostatic latent image bearer with the at least one first electric discharge wire of the first electric charging unit is a second threshold value or more, the control unit increases a value of electric discharge current passed through the at least one first electric discharge wire of the first electric charging unit.

According to yet another aspect of the present invention, since it is determined to implement a pre-electric charge removal electric charging process when the environment of the image forming apparatus tends to cause a phenomenon, in which a polarity of the surface potential of the rotary photoconductor 1 is reversed after execution of a transfer process, such as when temperature and humidity is high, etc., the afterimage generation phenomenon can be reduced. Further, since it is determined not to implement the pre-electric charge removal electric charging process when the environment of the image forming apparatus rarely causes the phenomenon, in which a polarity of the surface potential of the rotary photoconductor 1 is reversed after execution of a transfer process, such as when temperature is high and humidity is low, when temperature and humidity are low, when temperature is low and humidity is high, etc., the afterimage generation phenomenon can be likely prevented while maintaining a prescribed span of life of the electrostatic latent image bearer while avoiding the light fatigue. That is, according to yet another aspect of the present invention, in the above-described image forming apparatus, the control unit determines if the series of the second irradiation process, the pre-electric charge removal electric charging process, and the first irradiation process of irradiating the surface of the electrostatic latent image bearer with the first electric charge removing light from the first electric charge removing device is to be implemented in accordance with the environment of the image forming apparatus.

According to yet another aspect of the present invention, as described earlier in an applicable embodiment, the second electric charge removing device such as the second erase lamp 30, etc., needs to diselectrify a negative potential of several hundred volts existing on an unexposed surface portion of the image bearer after completion of the transfer process. Meanwhile, since the first electric charge removing device such as the first erase lamp 31, etc., only needs to diselectrify a potential of about −30 volts, the first electric charge removing device can preferably diselectrify the surface of the rotary photoconductor with a less amount of electric charge removing light than the second electric charge removing device. Hence, according to yet another aspect of the present invention, since the amount of electric charge removing light emitted by the first light except device is decreased to be smaller than that emitted by the second electric charge removing device, a surface portion charged by the first electric discharge wire 53 can be preferably diselectrified while suppressing occurrence of the afterimage at the same time as well. Further, when compared with a system in which the amount of electric charge removing light emitted from the first electric charge removing device is equalized with that emitted from the second electric charge removing device, deterioration of the surface of the electrostatic latent image bearer due to the light fatigue can be more effectively suppressed. Furthermore, when also compared with a system in which the amount of electric charge removing light emitted from the first electric charge removing device is equalized with that emitted from the second electric charge removing device, a voltage applied to the first electric charge removing device can be more effectively reduced thereby effectively saving power. That is, according to yet another aspect of the present invention, a quantity of the first electric charge removing light emitted from the first electric charge removing device is smaller than that of the second electric charge removing light emitted from the second electric charge removing device.

According to yet another aspect of the present invention, although the electric charging unit that applies a bias having a negative polarity to the electrostatic latent image bearer is employed, and accordingly, an amount of electric discharge products increasingly adheres to the electric discharge wire, the electric discharge wire can avoid its poor electric discharging because the cleaning unit removes the electric discharge products. That is, according to yet another aspect of the present invention, the image forming apparatus further includes a cleaning unit provided in at least one of the first electric charging unit and the second electric charging unit to remove corona products generated by the at least one of the first electric charging unit and the second electric charging unit.

According to yet another aspect of the present invention, although an electric charging unit that applies a bias voltage having a negative polarity to the electrostatic latent image bearer is employed, and accordingly an emission amount of ozone especially increases during electric discharging operation to execute the electric charging process, a density of ozone generated by an ozone treatment device and contained in air can be reduced to a harmless level because the air containing ozone can be purified. That is, according to this aspect of the present invention, the image forming apparatus further includes an ozone treatment device to collect and purify air containing ozone generated by at least one of the first electric charging unit and the second electric charging unit.

According to yet another aspect of the present invention, as described in the first modification, when compared with a system, in which the electric charge removing device such as the first erase lamp 31, etc., is disposed along a normal line of the electrostatic latent image bearer, irradiation of an electric discharge region T1 (i.e., an electrified region) on the surface of the electrostatic latent image bearer charged with electricity by the electric discharge wire (i.e., the second electric discharge wire 52 in the first modification that uniformly charges the surface of the electrostatic latent image bearer with electric charge removing light emitted from the electric charge removing device can be effectively reduced. With this, since a surface of the electrostatic latent image bearer is rarely diselectrified by the electric charge removing light emitted from the electric charge removing device immediately after the surface of the electrostatic latent image bearer is uniformly charged by the electric discharge wire, decreasing in charging performance of the electric charging unit caused by the electric charge removing device can be likely suppressed. That is, according to yet another aspect of the present invention, in the above-described image forming apparatus, the first electric charge removing device is inclined from a normal line of the electrostatic latent image bearer to direct an electric charge removing light irradiation plane thereof downstream of the normal line in a surface moving direction of the electrostatic latent image bearer.

According to yet another aspect of the present invention, as described in the second modification, when compared with a system in which the electric charge removing device such as the first erase lamp 31, etc., is disposed above a housing of the electric charging unit, the region of the electric charge removing light emitted onto the surface of the electrostatic latent image bearer can be more effectively narrowed in the surface moving direction of the electrostatic latent image bearer. Hence, when compared with a system, in which the electric charge removing device such as the first erase lamp 31, etc., is disposed above the housing of the electric charging unit, irradiation of an electric discharge region T1 (i.e., an electrified region) on the surface of the electrostatic latent image bearer charged with electricity by the electric discharge wire (i.e., the second electric discharge wire 52 in the second modification that uniformly charges the surface of the electrostatic latent image bearer) with electric charge removing light emitted from the electric charge removing device can be more effectively reduced. With this, since a surface of the electrostatic latent image bearer is rarely diselectrified by the electric charge removing light emitted from the electric charge removing device immediately after the surface of the electrostatic latent image bearer is uniformly charged by the electric discharge wire, decreasing in charging performance of the electric charging unit caused by the electric charge removing device can be likely suppressed. Further, the image forming apparatus can be more effectively downsized when compared with the system in which the electric charge removing device is disposed above the housing of the electric charging unit. Furthermore, when the electric charge removing device is attached to the housing of the electric charging unit, the electric charge removing device and the electric charging unit can be integrally detachably attached to a main body of the image forming apparatus at the same time. Furthermore, since a connector to connect the electric charge removing device with a power source provided in the main body of the image forming apparatus and that to connect the electric charging unit with the power source can be readily united as a single connector, the configuration of the image forming apparatus can be simplified. That is, according to yet another aspect of the present invention, in the above-described image forming apparatus, the first electric charge removing device is accommodated in the single housing (i.e., the electric discharge shields 56, 55, and 54, in another aspect of the present invention).

According to yet another aspect of the present invention, as described in the third modification, the light shield such as an independent light shield 156, etc., can block off the electric charge removing light irradiated from the electric charge removing device, such as the first erase lamp 31, etc., and directed to the electric discharge region T1 (i.e., the electrified region) on the surface of the electrostatic latent image bearer charged with electricity by the electric discharge wire (e.g., the second electric discharge wire 52 in the third modification). With this, since a surface of the electrostatic latent image bearer is rarely diselectrified by electric charge removing light of the electric charge removing device immediately after the surface of the electrostatic latent image bearer is uniformly charged by the electric discharge wire, decreasing in charging performance of the electric charging unit caused by the electric charge removing device can be likely prevented. That is, according to yet another aspect of the present invention, the image forming apparatus further includes a light shield to shield an electrified region on the surface of the electrostatic latent image bearer from the first electric charge removing light irradiated from the first electric charge removing device. The electrified region is provided with electric charge by the at least one electric discharge wire of the first charging unit to uniformly charge thereof.

According to yet another aspect of the present invention, as described in the third modification, the electric charge removing light emitted from the electric charge removing device can be likely completely inhibited from entering the above-described electric discharging region. That is, according to yet another aspect of the present invention, in the above-described image forming apparatus, the light shield is disposed between the at least one electric discharge wire of the first charging unit that uniformly electrifies the surface of the electrostatic latent image bearer and the first electric charge removing device. The light shield contacts a surface of the electrostatic latent image bearer.

According to yet another aspect of the present invention, as described in the fourth modification, when compared with a system, in which an interval between the electric discharge wires is the same, the electric charge removing device such as the first erase lamp 31, etc., can be disposed further away from the electric discharge wire (e.g., the second electric discharge wire 52) that uniformly charges the surface of the electrostatic latent image bearer, which is disposed next to the electric discharge wire (e.g., the first electric discharge wire 53) that charges the surface of the electrostatic latent image bearer with electricity to execute the pre-electric charge removal electric charging process subsequent to the transfer process. With this, the electric charge removing device can be disposed so that the irradiation region W on the surface of the electrostatic latent image bearer, which is irradiated by the electric charge removing device, does not overlap with the electric discharge region T1 of the surface of the electrostatic latent image bearer, which is uniformly charged with electricity by the electric discharge wire (e.g., the second electric discharge wire 52). With this, since a surface of the electrostatic latent image bearer is rarely diselectrified by electric charge removing light of the electric charge removing device immediately after the surface of the electrostatic latent image bearer is uniformly charged by the electric discharge wire, decreasing in charging performance of the electric charging unit caused by the electric charge removing device can be likely suppressed. That is, according to yet another aspect of the present invention, in the above-described image forming apparatus, the electric charging unit of the first charger that uniformly electrifies the surface of the electrostatic latent image bearer includes multiple first electric discharge wires. An interval between the second electric discharge wire that electrifies the surface of the electrostatic latent image bearer in the pre-electric charge removal electric charging process subsequent to the transfer process and one of the at least one first electric discharge wire adjacent to the second electric discharge wire, which uniformly electrifies the surface of the electrostatic latent image bearer, is wider than an interval between adjacent ones of the at least one first electric discharge wire that uniformly electrifies the surface of the electrostatic latent image bearer.

According to yet another aspect of the present invention, as described in an applicable embodiment, a prescribed value of electric current required to charge the surface of the electrostatic latent image bearer at a prescribed surface potential to form an electrostatic latent image thereon can be passed through each of the electric discharge wires (e.g., the second and third electric discharge wires 52 and 51) that uniformly charges the surface of the electrostatic latent image bearer with electricity. At the same time, a value of electric current needed to decrease a charged potential existing on the surface of the rotary photoconductor from about +30 volts to 0 volts can be passed through the electric discharge wire (i.e., the first electric discharge wire 53) that executes the pre-electric charge removal electric charging process to charge the surface of the electrostatic latent image bearer with electricity after completion of the transfer process. Hence, since electric discharging of the electric discharge wire (i.e., the first electric discharge wire 53) executed in the pre-electric charge removal electric charging process that charges the surface of the electrostatic latent image bearer with electricity after completion of the transfer process can be reduced, occurrence of electric discharge products, such as ozone, etc., can be likely suppressed. That is, according to yet another aspect of the present invention, in the above-described image forming apparatus, an electric current is separately passed through each of the second electric discharge wire that electrifies the surface of the electrostatic latent image bearer in the pre-electric charge removal electric charging process subsequent to the transfer process and the at least one first electric discharge wire that uniformly electrifies the surface of the electrostatic latent image bearer.

According to yet another aspect of the present invention, as described in an applicable embodiment, the electric discharge wires (e.g., the second and third electric discharge wires 52 and 51) that uniformly charges the surface of the electrostatic latent image bearer with electricity need to negatively charge the surface thereof at least at about −550 volts. By contrast, the electric discharge wire (e.g., the first electric discharge wire 53) that executes the pre-electric charge removal electric charging process to charge the surface of the electrostatic latent image bearer with electricity after completion of the transfer process may need to electrify the surface of the rotary photoconductor by a degree capable of decreasing an electrostatic potential from about +30 volts to 0 volts. Hence, the electrostatic potential about +30 volts existing on the surface of the rotary photoconductor can be decreased down to 0 volts with a less value of electric current than that passed through the electric discharge wires which uniformly charge the surface of the electrostatic latent image bearer with electricity. Accordingly, since the value of electric current passed through the electric discharge wire (e.g., the first electric discharge wire 53) that executes the pre-electric charge removal electric charging process to charge the surface of the electrostatic latent image bearer with electricity after completion of the transfer process is decreased to a lower level than that passed through the electric discharge wires (e.g., the second and third electric discharge wires 52 and 51) which uniformly charge the surface of the electrostatic latent image bearer with electricity, the afterimage can be reduced while suppressing the occurrence of electric discharge products such as ozone, etc. That is, according to yet another aspect of the present invention, in the above-described image forming apparatus, a value of electric current passed through the second electric discharge wire that electrifies the surface of the electrostatic latent image bearer in the pre-electric charge removal electric charging process subsequent to the transfer process is smaller than that passed through the first electric discharge wire that uniformly electrifies the surface of the electrostatic latent image bearer.

According to yet another aspect of the present invention, as described in an applicable embodiment, electric charge removing light emitted from the electric charge removing device such as the first erase lamp, etc., can reach the surface of the rotary photoconductor without being impeded by a grid, thereby capable of increasing electric charge removing ability. Further, since a surface of the rotary photoconductor is better diselectrified with a lesser amount of light, a voltage applied to the electric charge removing device can be reduced as well. With this, energy can be saved, accordingly. That is, according to yet another aspect of the present invention, the image forming apparatus further includes a second grid disposed between the second electric discharge wire that electrifies the surface of the electrostatic latent image bearer in the pre-electric charge removal electric charging process subsequent to the transfer process and the electrostatic latent image bearer. The image forming apparatus further includes a first grid disposed between the electric discharge wire that uniformly electrifies the surface of the electrostatic latent image bearer and the electrostatic latent image bearer. A ratio of an opening of the second grid disposed between the second electric discharge wire that electrifies the surface of the electrostatic latent image bearer in the pre-electric charge removal electric charging process subsequent to the transfer process and the electrostatic latent image bearer is greater than that of an opening of the first grid disposed between the first electric discharge wire that uniformly electrifies the surface of the electrostatic latent image bearer and the electrostatic latent image bearer. Otherwise, the first grid is disposed between the at least one first electric discharge wire and the electrostatic latent image bearer while the second grid is not installed between the second electric discharge wire and the electrostatic latent image bearer for the same purpose.

According to yet another aspect of the present invention, since an electric charging unit other than that uniformly charges the electrostatic latent image bearer is not needed to employ as another member, a phenomenon in which the afterimage occurs can be effectively prevented or reduced as well. That is, according to yet another aspect of the present invention, the image forming apparatus further includes multiple image formation devices, each including the electrostatic latent image bearer and the developing device, to form color images of different colors. A full-color image is formed by superimposing the color images formed by the respective multiple image formation devices one on another on a transfer medium.

Numerous additional modifications and variations of the present invention are possible in light of the above teachings. It is therefore to be understood that within the scope of the appended claims, the present invention may be executed otherwise than as specifically described herein. For example, the image forming apparatus is not limited to the above-described various embodiments and modifications and may be altered as appropriate.

Further, the method of forming an image is not limited to the above-described various embodiments and may be altered as appropriate. For example, steps of the method of forming an image can be altered as appropriate.

What is claimed is:

1. An image forming apparatus, comprising:

a rotary electrostatic latent image bearer to bear an electrostatic latent image;

a first electric charging unit having at least one first electric discharge wire to uniformly electrify a surface of the electrostatic latent image bearer;

an electrostatic latent image writing device to write an electrostatic latent image on the surface of the electrostatic latent image bearer electrified by the first electric charging unit;

a developing device to render the electrostatic latent image borne on the electrostatic latent image bearer visible as a toner image with toner;

a transfer device to transfer the toner image obtained by developing the electrostatic latent image onto a transfer medium in a transfer process;

a second electric charging unit having a second electric discharge wire to execute a pre-electric charge removal electric charging process by electrifying the surface of the electrostatic latent image bearer subsequent to the transfer process executed by the transfer device;

a first electric charge removing device to diselectrify the surface of the electrostatic latent image bearer by irradiating the surface of the electrostatic latent image bearer with first electric charge removing light subsequent to the pre-electric charge removal electric charging process;

a second electric charge removing device to irradiate the surface of the electrostatic latent image bearer with second electric charge removing light, the second electric charge removing device opposed to the electrostatic latent image bearer between the transfer device and the first electric charging unit; and a control unit to control operation of a first irradiation process of irradiating the surface of the electrostatic latent image bearer with the first electric charge removing light from the first electric charge removing device, a second irradiation process of irradiating the surface of the electrostatic latent image bearer with the second electric charge removing light from the second electric charge removing device, and the pre-electric charge removal electric charging process, wherein the control unit initiates one of the second irradiation process executed as a single diselectrifying process and a series of the second irradiation process, the pre-electric charge removal electric charging process, and the first irradiation process executed in this order as a complex diselectrifying process, wherein the at least one first electric discharge wire provided in the first electric charging unit and the second electric discharge wire provided in the second electric charging unit are accommodated in a single housing, wherein the second electric discharge wire provided in the second electric charging unit is disposed upstream of the at least one first electric discharge wire in a rotational direction of the electrostatic latent image bearer, wherein the first electric charge removing device is disposed within an electric discharge region of the second electric discharge wire and irradiates the surface of the electrostatic latent image bearer with the electric charge removing light on a downstream side of an extreme upstream edge of the electric discharge region of the second electric discharge wire in the rotational direction of the electrostatic latent image bearer.

2. The image forming apparatus as claimed in claim 1, wherein the control unit initiates the series of the second irradiation process, the pre-electric charge removal electric charging process, and the first irradiation process when an absolute value of a potential existing after completion of the transfer process in a surface portion of the electrostatic latent image bearer in which the electrostatic latent image is written is less than a prescribed first threshold value.

3. The image forming apparatus as claimed in claim 2, wherein when the first electric charge removing device removes electric charge from the surface of the electrostatic latent image bearer and an absolute value of a target potential to be obtained by uniformly charging the surface of the electrostatic latent image bearer with the at least one first electric discharge wire of the first electric charging unit is a second threshold value or more, the control unit increases a value of electric discharge current passed through the at least one first electric discharge wire of the first electric charging unit.

4. The image forming apparatus as claimed in claim 1, wherein the control unit initiates the second irradiation process while prohibiting the series of the second irradiation process, the pre-electric charge removal electric charging process, and the first irradiation process when an absolute value of a potential existing after completion of the transfer process in a surface portion of the electrostatic latent image bearer in which the electrostatic latent image is written is a prescribed first threshold value or more.

5. The image forming apparatus as claimed in claim 1, wherein the control unit determines if the series of the second irradiation process, the pre-electric charge removal electric charging process, and the first irradiation process is to be executed in accordance with an environment of the image forming apparatus.

6. The image forming apparatus as claimed in claim 1, wherein a quantity of the first electric charge removing light emitted from the first electric charge removing device is smaller than a quantity of the second electric charge removing light emitted from the second electric charge removing device.

7. The image forming apparatus as claimed in claim 1, further comprising a cleaning unit provided in at least one of the first electric charging unit and the second electric charging unit to remove corona products generated by the at least one of the first electric charging unit and the second electric charging unit.

8. The image forming apparatus as claimed in claim 1, further comprising an ozone treatment device to collect and purify air containing ozone generated by at least one of the first electric charging unit and the second electric charging unit.

9. The image forming apparatus as claimed in claim 1, wherein the first electric charge removing device is inclined from a normal line of the electrostatic latent image bearer to direct an electric charge removing light irradiation plane thereof downstream of the normal line in a surface moving direction of the electrostatic latent image bearer.

10. The image forming apparatus as claimed in claim 1, wherein the first electric charge removing device is accommodated in the housing.

11. The image forming apparatus as claimed in claim 1, further comprising a light shield to shield an electrified region on the surface of the electrostatic latent image bearer from the first electric charge removing light radiated from the first electric charge removing device, the electrified region provided with a uniform electric charge by the at least one first electric discharge wire of the first charging unit.

12. The image forming apparatus as claimed in claim 11, wherein the light shield is disposed in contact with a surface of the electrostatic latent image bearer between the at least one first electric discharge wire and the first electric charge removing device.

13. The image forming apparatus as claimed in claim 1, wherein an interval between the second electric discharge wire and the at least one first electric discharge wire adjacent to the second electric discharge wire is wider than an interval between adjacent ones of the at least one first electric discharge wire.

14. The image forming apparatus as claimed in claim 1, wherein an electric current is separately passed through each of the second electric discharge wire and the at least one first electric discharge wire.

15. The image forming apparatus as claimed in claim 14, wherein a value of electric current passed through the second electric discharge wire is smaller than that passed through the at least one first electric discharge wire.

16. The image forming apparatus as claimed in claim 1, further comprising:

a second grid disposed between the second electric discharge wire and the electrostatic latent image bearer; and a first grid disposed between the at least one electric discharge wire and the electrostatic latent image bearer, wherein either a ratio of an opening of the second grid disposed between the second electric discharge wire and the electrostatic latent image bearer is greater than a ratio of an opening of the first grid disposed between the at least one first electric discharge wire and the electrostatic latent image bearer, or the first grid is disposed between the at least one first electric discharge wire and the electrostatic latent image bearer while the second grid is not installed between the second electric discharge wire and the electrostatic latent image bearer.

17. The image forming apparatus as claimed in claim 1, further comprising multiple image formation devices, each including the electrostatic latent image bearer and the developing device, to form color images of different colors, wherein a full-color image is formed by superimposing the color images formed by the respective multiple image formation devices one on another on a transfer medium.

18. A method of forming an image, comprising the steps of:

rotating an electrostatic latent image bearer with a motor;

uniformly electrifying a surface of the electrostatic latent image bearer with a first electric charging unit having at least one first electric discharge wire;

optically writing an electrostatic latent image on the surface of the electrostatic latent image bearer electrified by the first electric charging unit with an electrostatic latent image writing device;

rendering the electrostatic latent image borne on the electrostatic latent image bearer visible as a toner image with toner stored in a developing device;

transferring the toner image obtained by developing the electrostatic latent image onto a transfer medium with a transfer device in a transfer process;

electrifying the surface of the electrostatic latent image bearer with a second electric charging unit having a second electric discharge wire in a pre-electric charge removal electric charging process after the step of transferring the toner image in the transfer process with the transfer device, the at least one first electric discharge wire and the second electric discharge wire accommodated in a housing, the second electric discharge wire disposed upstream of the at least one first electric discharge wire in a rotational direction of the electrostatic latent image bearer; and diselectrifying the surface of the electrostatic latent image bearer by irradiating the surface of the electrostatic latent image bearer with first electric charge removing light from a first electric charge removing device after the step of electrifying the surface of the electrostatic latent image bearer in the pre-electric charge removal electric charging process, the first electric charge removing device disposed within an electric discharge region of the second electric discharge wire, the first electric charge removing device irradiating the surface of the electrostatic latent image bearer with the first electric charge removing light on a downstream side of an extreme upstream edge of the electric discharge region of the second electric discharge wire in the rotational direction of the electrostatic latent image bearer;

irradiating the surface of the electrostatic latent image bearer with second electric charge removing light with a second electric charge removing device opposed to the electrostatic latent image bearer between the transfer device and the first electric charging unit; and selectively implementing one of a second irradiation process of irradiating the surface of the electrostatic latent image bearer with the second electric charge removing light from the second electric charge removing device as a single diselectrifying process and a series of the second irradiation process, the pre-electric charge removal electric charging process, and a first irradiation process of irradiating the surface of the electrostatic latent image bearer with the first electric charge removing light from the first electric charge removing device executed in this order as a complex diselectrifying process.

* * * * *